US008325116B2

(12) United States Patent
Takasugi et al.

(10) Patent No.: US 8,325,116 B2
(45) Date of Patent: Dec. 4, 2012

(54) IMAGE DISPLAY APPARATUS, AND IMAGE DISPLAY APPARATUS DRIVING METHOD

(75) Inventors: Shinji Takasugi, Kanagawa (JP); Kohei Ebisuno, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 582 days.

(21) Appl. No.: 12/525,483

(22) PCT Filed: Jan. 31, 2008

(86) PCT No.: PCT/JP2008/051549

§ 371 (c)(1),
(2), (4) Date: Jul. 31, 2009

(87) PCT Pub. No.: WO2008/093792

PCT Pub. Date: Aug. 7, 2008

(65) Prior Publication Data

US 2010/0103081 A1 Apr. 29, 2010

(30) Foreign Application Priority Data

Feb. 1, 2007 (JP) ..... 2007-023195

(51) Int. Cl.
*G09G 3/30* (2006.01)

(52) U.S. Cl. ..... 345/77; 345/82

(58) Field of Classification Search ..... 345/76–82, 345/84

See application file for complete search history.

(56) References Cited

U.S. PATENT DOCUMENTS

| | | | | |
|---|---|---|---|---|
| 5,777,361 | A | 7/1998 | Parris et al. | |
| 6,229,506 | B1 | 5/2001 | Dawson et al. | |
| 2003/0227797 | A1* | 12/2003 | Jung | 365/189.05 |
| 2004/0174354 | A1* | 9/2004 | Ono et al. | 345/204 |
| 2005/0017934 | A1 | 1/2005 | Chung et al. | |
| 2005/0093464 | A1* | 5/2005 | Shin et al. | 315/169.1 |
| 2005/0237273 | A1 | 10/2005 | Ozawa et al. | |
| 2006/0028407 | A1* | 2/2006 | Chou | 345/76 |
| 2006/0066644 | A1 | 3/2006 | Yamaguchi et al. | |

(Continued)

FOREIGN PATENT DOCUMENTS

JP 2002-514320 A 5/2002

(Continued)

OTHER PUBLICATIONS

Korean Decision of Refusal dated Apr. 28, 2011.

*Primary Examiner* — Chanh Nguyen
*Assistant Examiner* — Pegeman Karimi
(74) *Attorney, Agent, or Firm* — Birch, Stewart, Kolasch & Birch, LLP

(57) ABSTRACT

An image display apparatus including a light-emitting device of which emission luminance varies with the amount of current, a first transistor in which the amount of current between a first electrode electrically connected to the light-emitting device and a second electrode is adjusted by the potential applied to a third electrode, so as to control the amount of current in the light-emitting device, a second transistor in which the amount of current between a fourth electrode electrically connected to the first electrode and a fifth electrode electrically connected to the third electrode is adjusted by the potential applied to a sixth electrode, and a capacitor having a seventh electrode electrically connected to the third electrode and an eighth electrode.

13 Claims, 18 Drawing Sheets

U.S. PATENT DOCUMENTS

| | | | | |
|---|---|---|---|---|
| 2007/0046592 | A1 | 3/2007 | Ono et al. | |
| 2007/0188670 | A1 * | 8/2007 | Lee | 349/43 |

FOREIGN PATENT DOCUMENTS

| | | | |
|---|---|---|---|
| JP | 2005-31630 | A | 2/2005 |
| JP | 2005-189673 | A | 7/2005 |
| JP | 2005-309150 | A | 11/2005 |
| JP | 2006-91654 | A | 4/2006 |
| JP | 2006-309258 | A | 11/2006 |
| KR | 10-0466902 | | 5/2005 |
| KR | 10-2008-0067800 | | 7/2005 |
| WO | WO-2006/103802 | A1 | 10/2006 |

* cited by examiner

IMAGE DISPLAY APPARATUS, AND IMAGE DISPLAY APPARATUS DRIVING METHOD

TECHNICAL FIELD

The present invention relates to apparatuses that display images.

BACKGROUND ART

Image display apparatuses having organic EL (Electroluminescent) devices utilizing electroluminescence are conventionally known.

In an organic EL device, for example, a transparent electrode and a metal electrode are placed opposite to each other, with organic layers, including a light-emitting layer, being sandwiched between them. In an organic EL device thus structured, when a voltage or current is applied across the transparent electrode and the metal electrode, current flows in the light-emitting layer and the light-emitting layer emits light, and the light emitted from the light-emitting layer passes through the transparent electrode to the outside. It is known that, for common organic EL devices, the current density of the light-emitting layer and the luminance are nearly proportional to each other, and a conventional example thereof is disclosed in a patent document (Japanese Patent Application Laid-Open No. 2006-309258), for example.

However, the deterioration of the organic EL devices is promoted as the current density of the organic EL devices is higher, leading to shorter life of the organic EL devices, and further to shorter life of the image display apparatus.

DISCLOSURE OF THE INVENTION

The present invention has been made by considering the problem above, and an object of the present invention is to provide a technique that enables longer life of an image display apparatus.

In order to solve the problem above, an image display apparatus according to a first aspect of the present invention includes: a light-emitting device of which emission luminance varies with the amount of current; and a first transistor having first electrode, second electrode and third electrode, wherein the amount of current between the first electrode and the second electrode is adjusted by a potential applied to the third electrode.

The image display apparatus further includes: a second transistor having fourth electrode, fifth electrode and sixth electrode, wherein the amount of current between the fourth electrode and the fifth electrode is adjusted by a potential applied to the sixth electrode; and a capacitor having seventh electrode and eighth electrode and forming a capacitance between the seventh electrode and the eighth electrode. The first electrode is electrically connected to the light-emitting device, and the amount of current in the light-emitting device is controlled by adjusting the amount of current between the first electrode and the second electrode. The fourth electrode is electrically connected to the first electrode, and the fifth electrode is electrically connected to the third electrode, and the seventh electrode is electrically connected to the third electrode. A parasitic capacitance between the fifth electrode and the sixth electrode is set at a larger value than a parasitic capacitance between the fourth electrode and the sixth electrode.

An image display apparatus according to a second aspect of the present invention includes: a light-emitting device of which emission luminance varies with the amount of current; a first transistor having first electrode, second electrode and third electrode, wherein the amount of current between the first electrode and the second electrode is adjusted by a potential applied to the third electrode; a second transistor having fourth electrode, fifth electrode and sixth electrode, wherein the amount of current between the fourth electrode and the fifth electrode is adjusted by a potential applied to the sixth electrode; and a capacitor having seventh electrode and eighth electrode and forming a capacitance between the seventh electrode and the eighth electrode. The first electrode is electrically connected to the light-emitting device, and the amount of current in the light-emitting device is controlled by adjusting the amount of current between the first electrode and the second electrode; the fourth electrode is electrically connected to the first electrode, the fifth electrode is electrically connected to the third electrode, and the seventh electrode is electrically connected to the third electrode.

A method for driving an image display apparatus according to a third aspect of the present invention is a method for driving an image display apparatus that includes: a light-emitting device of which emission luminance varies with the amount of current; a first transistor having first electrode, second electrode and third electrode, wherein the amount of current between the first electrode and the second electrode is adjusted by a potential applied to the third electrode; a second transistor having fourth electrode, fifth electrode and sixth electrode, wherein the amount of current between the fourth electrode and the fifth electrode is adjusted by a potential applied to the sixth electrode; and a capacitor having seventh electrode and eighth electrode and forming a capacitance between the seventh electrode and the eighth electrode. The first electrode is electrically connected to the light-emitting device, and the amount of current in the light-emitting device is controlled by adjusting the amount of current between the first electrode and the second electrode; the fourth electrode is electrically connected to the first electrode, the fifth electrode is electrically connected to the third electrode, and the seventh electrode is electrically connected to the third electrode. The driving method includes: a threshold compensation step in which a first potential is applied to the second electrode, and charge corresponding to a threshold voltage of the first transistor is accumulated in the capacitor while the second transistor is set in a conducting state where current can flow between the fourth electrode and the fifth electrode so as to compensate for the threshold voltage; and a step in which the potential applied to the second electrode is varied from the first potential to a second potential at approximately the same time as a timing with which the second transistor varies from the conducting state to a non-conducting state where current cannot flow between the fourth electrode and the fifth electrode.

<Explanation of Terms>

In this specification, "gate voltage" means the gate potential with respect to the source, and it is represented also as "Vgs".

Also, in this specification, "threshold voltage" means the gate voltage as a boundary at which a transistor changes from the off state (i.e. a state in which drain current does not flow) to the on state (a state in which drain current flows), and "threshold voltage" is also represented simply as "threshold".

BEST MODE FOR CARRYING OUT THE INVENTION

Figure 1:
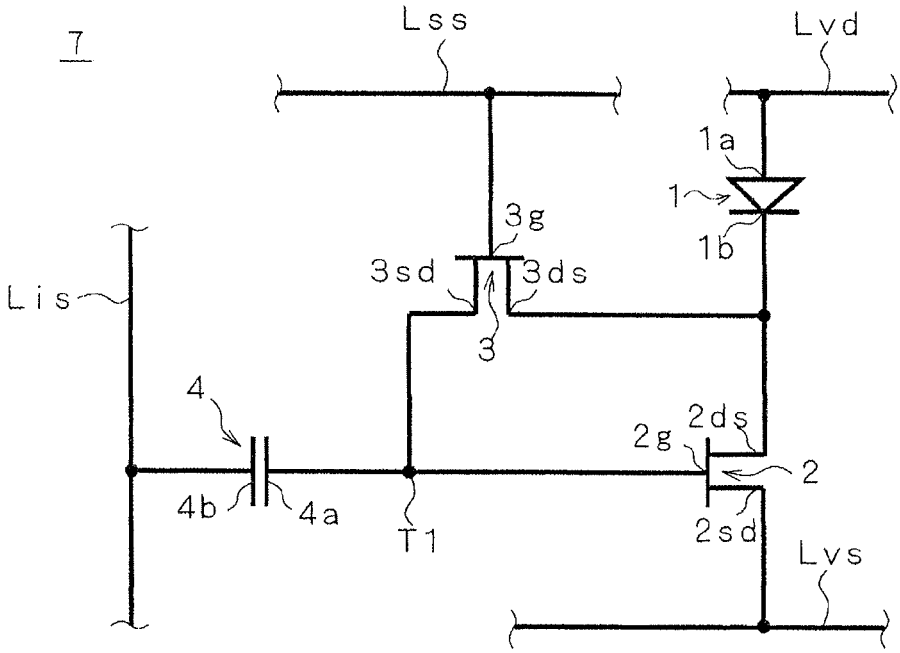
FIG. 1 is a diagram illustrating a pixel circuit 7 of an image display apparatus according to a technique compared with the present invention.

Now, the preferred embodiments of the present invention will be described referring to the drawings.

Before describing the preferred embodiments, an image display apparatus as a comparison with the image display apparatus of the preferred embodiments of the invention described later (an image display apparatus according to a comparative technique) will be described referring to FIGS. 1 to 13. Now, the image display apparatus has an organic EL display in which, generally, emission luminance is adjusted with current value. In this image display apparatus, a large number of pixels are arranged with an organic EL device provided in each pixel.

<Configuration of Pixel Circuit>

FIG. 1 is a diagram illustrating an example configuration of a pixel circuit (driving circuit) 7 for one pixel in the image display apparatus of the comparative technique.

The pixel circuit 7 includes an organic. EL device (OLED) 1, a driving transistor 2, a threshold (Vth) compensation transistor 3, and a capacitor 4.

The organic EL device 1, made of organic matter and the like, is a light-emitting device of which emission luminance varies with the amount of current flowing in the light-emitting layer. The organic EL device 1 has an anode electrode 1*a* and a cathode electrode 1*b*, and the anode electrode 1*a* is electrically connected to a VDD line Lvd as a power-supply line serving as the high-potential side when the organic EL device 1 emits light. The cathode electrode 1*b* is electrically connected through the driving transistor 2 to a VSS line Lvs as a power-supply line serving as the low-potential side when the organic EL device 1 emits light.

The driving transistor 2 is electrically connected in series with the organic EL device 1, and this is a transistor that controls the emission luminance of the organic EL, device 1 by adjusting the amount of current in the organic EL device 1. Here, the driving transistor 2 is formed of a thin film transistor (TFT) that is a kind of field effect transistor (FET) adopting MIS (Metal Insulator Semiconductor) structure of a type (n type) where the carriers are electrons, i.e. an n-MISFETTFT.

The driving transistor 2 has first to third electrodes 2*ds*, 2*sd* and 2*g*. The first electrode 2*ds* is electrically connected to the cathode electrode 1*b* of the organic EL device 1, and it functions as the drain electrode (hereinafter referred to simply as "drain") when the organic EL device 1 emits light, i.e. when forward current flows to the organic EL device 1. It functions as the source electrode (hereinafter referred to simply as "source") when reverse current flows to the organic EL device 1. The second electrode 2*sd* is electrically connected to the VSS line Lvs, and it functions as the source electrode (source)

when forward current flows to the organic EL device 1. It functions as the drain electrode (drain) when reverse current flows to the organic EL device 1. The third electrode 2*g* is a so-called gate electrode (hereinafter referred to simply as "gate") and it is electrically connected to one electrode (seventh electrode 4*a*) of the capacitor 4.

In the driving transistor 2, the amount of current flowing between the first electrode 2*ds* and the second electrode 2*sd* (hereinafter also referred to as "between the first-second electrodes") is adjusted by adjusting the potential applied to the third electrode 2*g*, more specifically the voltage value applied across the first electrode 2*ds* or second electrode 2*sd* and the third electrode 2*g* (i.e. across the gate and source). With the potential applied to the third electrode (gate) 2*g*, the driving transistor 2 is selectively set in a state where current can flow (a conducting state) between the first-second electrodes (i.e. between the drain and source) and a state where current cannot flow (a non-conducting state).

The Vth compensation transistor 3 is a transistor that detects the lower-limit value (a given threshold voltage Vth) of the potential of the third electrode 2*g* of the driving transistor 2 with respect to the second electrode 2*sd* when the driving transistor 2 goes into the conducting state, and that adjusts the gate voltage of the driving transistor 2 to the threshold voltage Vth (hereinafter referred to simply as "threshold Vth"). Here, like the driving transistor 2, the Vth compensation transistor 3 is also formed of an n-MISFETTFT.

The Vth compensation transistor 3 has fourth to sixth electrodes 3*ds*, 3*sd* and 3*g*. The fourth electrode 3*ds* is conductively connected to the interconnection that electrically connects the first electrode 2*ds* of the driving transistor 2 and the cathode electrode 1*b* of the organic EL device 1. That is, the fourth electrode 3*ds* is electrically connected to the first electrode 2*ds* of the driving transistor 2. The fifth electrode 3*sd* is conductively connected, at a connection point T1, to the interconnection that electrically connects the third electrode (gate) 2*g* of the driving transistor 2 and the capacitor 4. That is, it is electrically connected to the gate 2*g* of the driving transistor 2. Also, the sixth electrode 3*g* is a so-called gate electrode, which is electrically connected to a scanning signal line Lss.

In the Vth compensation transistor 3, the amount of current flowing (the amount of current) between the fourth electrode 3*ds* and the fifth electrode 3*sd* (hereinafter also referred to as "between the fourth-fifth electrodes) is adjusted by adjusting the potential applied to the sixth electrode 3*g*, more specifically the voltage value applied across the fourth electrode 3*ds* or fifth electrode 3*sd* and the sixth electrode 3*g* (i.e. across the gate and source). With the potential applied to the sixth electrode (gate) 3*g*, the Vth compensation transistor 3 is selectively set in a state where current can flow (a conducting state) between the fourth-fifth electrodes (between the drain and source), and a state where current cannot flow (a non-conducting state).

Now, in the organic EL device 1, the emission luminance is controlled with the current value, so that the emission luminance sensitively varies with the variation of the gate voltage of the driving transistor 2 during emission. Particularly, when the driving transistor 2 is made of amorphous silicon, the threshold Vth tends to vary among driving transistors 2. Accordingly, desired emission luminance and actual emission luminance differ in the absence of a function of compensating for the threshold Vth that differs among pixels (Vth compensation function), leading to unevenness of emission luminance among pixels.

Accordingly, the Vth compensation transistor 3 is provided to realize the Vth compensation function of compensating for the variation of threshold Vth of driving transistors 2 by adjusting the gate voltage of the driving transistor 2 of each pixel to the threshold Vth before light is emitted.

The capacitor 4 includes a seventh electrode 4*a* electrically connected to the third electrode 2*g* of the driving transistor 2, and an eighth electrode 4*b* electrically connected to an image signal line Lis. The capacitance held by the capacitor 4 is represented as a given value Cs.

Now, when voltage reverse to that for light emission is applied, the organic EL device 1 functions as a capacitor, and its capacitance (EL device capacitance) is represented as a given value Co. Also, the driving transistor 2 has a parasitic capacitance CgsTd between the second electrode 2*sd* and the third electrode 2*g* (hereinafter also referred to as "between the second-third electrodes") and a parasitic capacitance CgdTd between the first electrode gds and the third electrode 2*g* (hereinafter also referred to as "between the first-third electrodes"). Also, the Vth compensation transistor 3 has a parasitic capacitance CgsTth between the fifth electrode 3*sd* and the sixth electrode 3*g* (hereinafter also referred to as "between the fifth-sixth electrodes") and a parasitic capacitance CgdTth between the fourth electrode 3*ds* and the sixth electrode 3*g* (hereinafter also referred to as "between the fourth-sixth electrodes"). The parasitic capacitances CgsTd. CgdTd. CgsTth and CgdTth are capacitances of given values that are determined by the structures respectively of the driving transistor 2 and the Vth compensation transistor 3.

Figure 2:
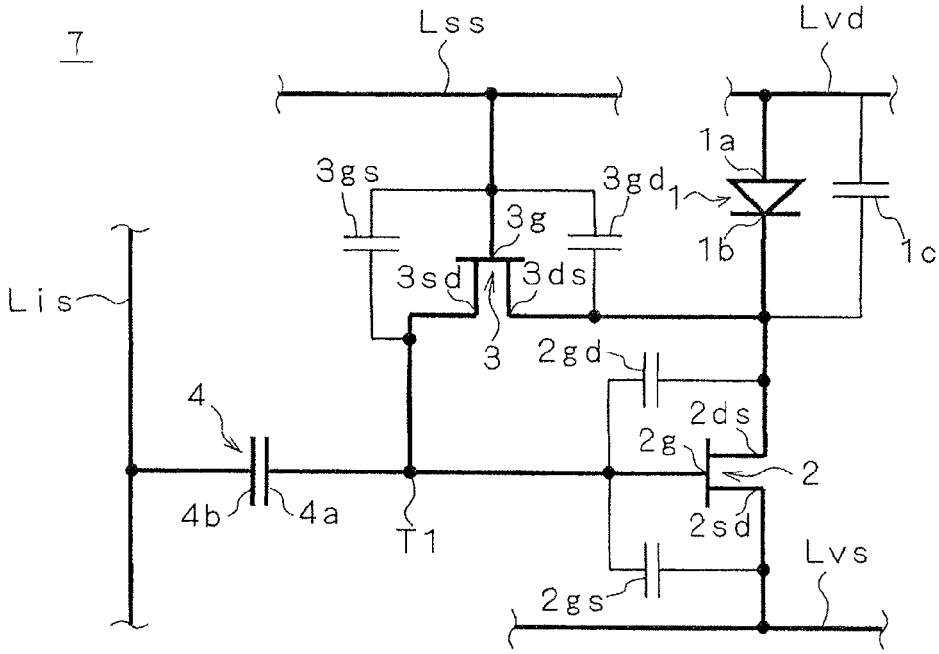
FIG. 2 is a diagram schematically illustrating parasitic capacitances generated in the pixel circuit 7 of the technique compared with the present invention.

FIG. 2 is a schematic diagram in which the circuit configuration with the parasitic capacitances CgsTth, CgdTth. CgsTd and CgdTd and the EL device capacitance Co (drawn in thin line) is added to the circuit configuration of the pixel circuit 7 shown in FIG. 1 (drawn in thick line).

As shown in FIG. 2, in the pixel circuit 7, a capacitor (element capacitor) 1*c* having the EL device capacitance Co exists between the two electrodes of the organic EL device 1, a capacitor 2*gs* having the parasitic capacitance CgsTd exists between the second-third electrodes of the driving transistor 2, and a capacitor 2*gd* having the parasitic capacitance CgdTd exists between the first-third electrodes of the driving transistor 2. Also, a capacitor 3*gs* having the parasitic capacitance CgsTth exists between the fifth-sixth electrodes of the Vth compensation transistor 3, and a capacitor 3*gd* having the parasitic capacitance CgdTth exists between the fourth-sixth electrodes of the Vth compensation transistor 3.

The description above focuses upon one pixel circuit 7, but a large number of pixel circuits 7 exist in the entire organic EL display. Accordingly, there are a large number of scanning signal lines Lss. The large number of scanning signal lines Lss may hereinafter be referred to as "Nth scanning signal line (N is a natural number) Lss".

<Driving Method for Light Emission of Organic EL Device>

Figure 3:
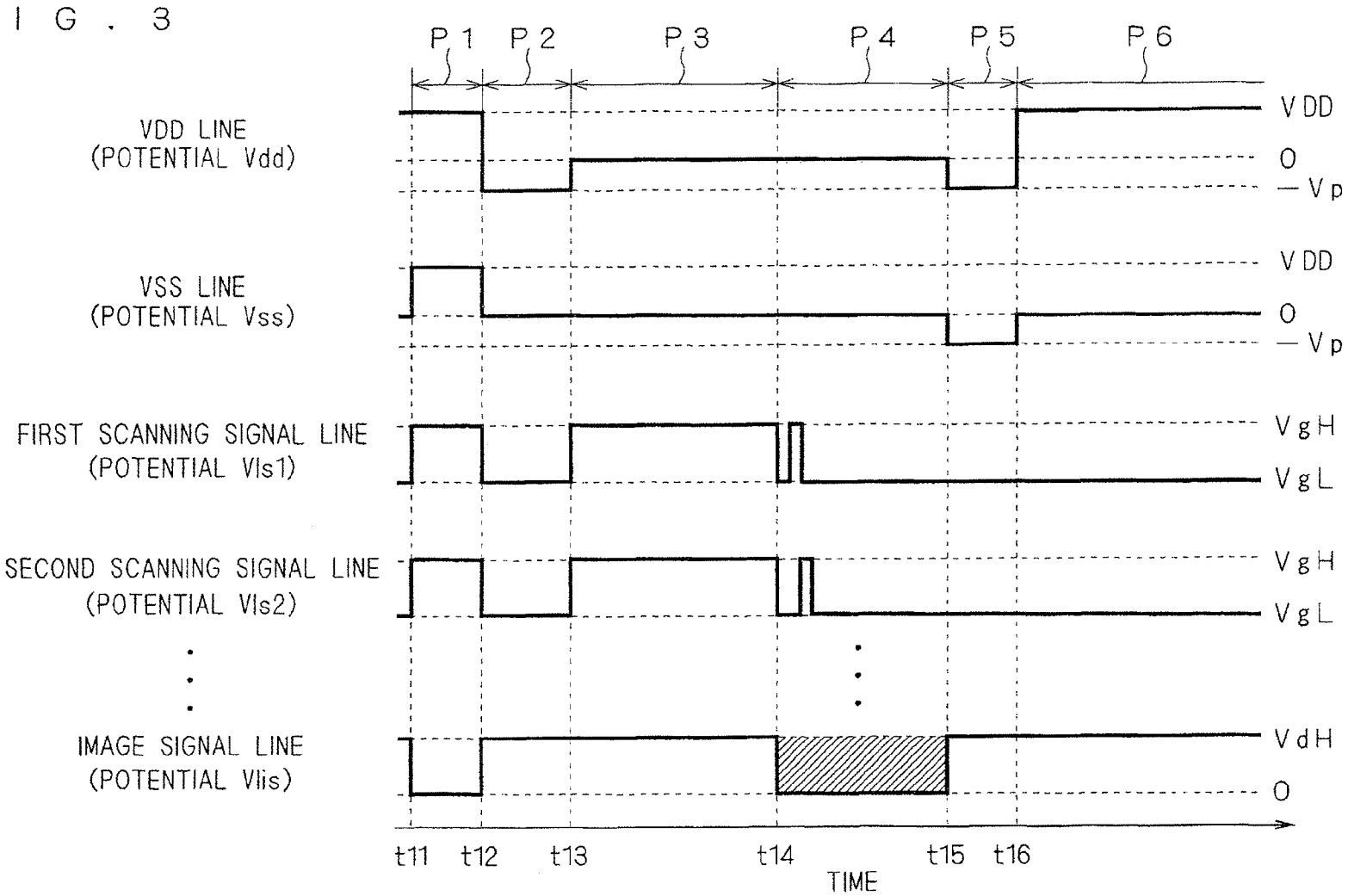
FIG. 3 is a timing chart illustrating driving waveforms for the image display apparatus of the technique compared with the present invention.

FIG. 3 is a timing chart illustrating signal waveforms (driving waveforms) for causing the organic EL device 1 to emit light. In FIG. 3, the horizontal axis indicates time, and the waveforms shown sequentially from top to bottom are (a) the potential applied to the VDD line Lvd (potential Vdd), (h) the potential applied to the VSS line Lvs (potential Vss), (c) the potential of signal applied to a first scanning signal line Lss (potential Vls1), (d) the potential of signal applied to the second scanning signal line Lss (potential Vls2), and (e) the potential of signal applied to the image signal line Lis (potential Vlis).

FIG. 3 shows driving waveforms for causing the organic EL device 1 to emit light once, and the period for one light emission includes, in time sequential order, Cs initialization period P1 (time t11 to t12), preparatory period P2 (time t12 to t13), Vth compensation period P3 (time t13 to t14), writing period P4 (time t14 to t15), element initialization period P5 (time t15 to t16), and light emission period P6 (time from t16). The potential Vlis in the writing period P4 is an arbitrary value that is determined by the emission luminance of each organic EL device 1, and therefore, in FIG. 3, the range where the potential can exist is shown with oblique hatching for the sake of convenience.

FIGS. 4 to 8 are diagrams illustrating the flow of current in the pixel circuit 7 that is generated in each period when the image display apparatus of the comparative technique is driven. In FIGS. 4 to 8, in the pixel circuit 7, circuits contributing to the flow of current are shown in thick line, and circuits hardly contributing to the flow of current are shown in thin line.

Now, referring to FIGS. 3 and 4 to 8, a method for driving the image display apparatus of the comparative technique will be described.

Figure 4:
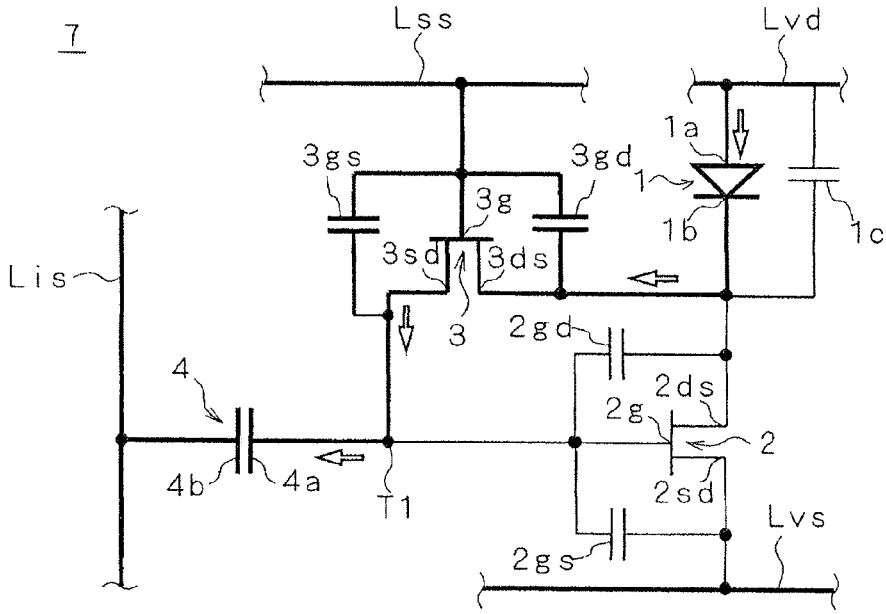
FIG. 4 is a circuit diagram illustrating the operation of the pixel circuit 7 of the technique compared with the present invention.

Cs Initialization Period P1:

FIG. 4 illustrates the flow of current in the pixel circuit 7 during the Cs initialization period P1 (hereinafter also referred to simply as "period P1").

In the period P1, a given positive high potential VDD (e.g. 15 V) is applied to the VDD line Lvd and the VSS line Lvs, a given positive high potential VgH (e.g. 15 V) is applied to all scanning signal lines Lss, and a given reference potential (0 V here) is applied to the image signal line Lis.

At this time, for the Vth compensation transistor 3, with the application of the high potential VgH to the scanning signal line Lss, a positive potential corresponding to the high potential VgH is applied to the sixth electrode (gate) 3*g*, and it becomes conductive. On the other hand, the driving transistor 2 is off and non-conductive because the VDD line Lvd and the VSS line Lvs are at approximately equal potentials.

Thus, in the period P1 as shown by blank arrows in FIG. 4, current flows from the VDD line Lvd to the capacitor 4 through the fourth and fifth electrodes 3*ds* and 3*sd* of the Vth compensation transistor 3, and a given amount of charge (e.g. an amount of charge corresponding to 15 V) is accumulated in the capacitor 4.

As time passes in the period P1, the amount of charge accumulated in the capacitor 4 increases, and then a positive potential over a given value is applied to the third electrode (gate) 2*g* of the driving transistor 2, and it may become conductive. However, no current flows between the first-second electrodes of the driving transistor 2 because the VDD line Lvd and the VSS line Lvs are both set at the same potential VDD.

Figure 5:
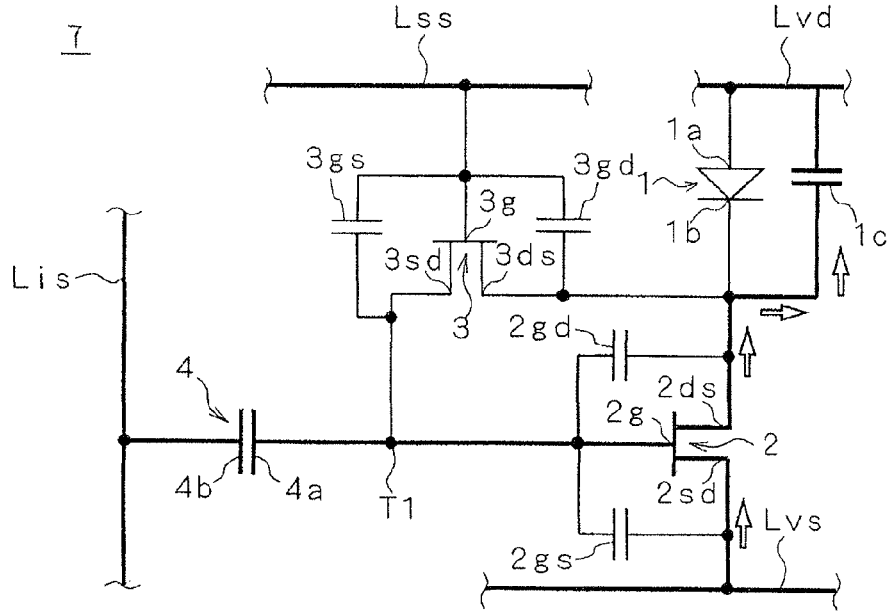
FIG. 5 is a circuit diagram illustrating the operation of the pixel circuit 7 of the technique compared with the present invention.

Preparatory Period P2:

FIG. 5 illustrates the flow of current in the pixel circuit 7 during the preparatory period P2 (hereinafter also referred to simply as "period P2").

In the period P2, a negative given potential Vp (e.g. −7V) is applied to the VDD line Lvd, a given reference potential (0 V here) is applied to the VSS line Lvs, a given low potential VgL (e.g. −10 V) is applied to all scanning signal lines Lss, and a given high potential VdH (e.g. 10 V) is applied to the image signal line Lis.

At this time, for the Vth compensation transistor 3, with the application of the low potential VgL to the scanning signal line Lss, almost no positive potential is applied to the sixth electrode (gate) 3*g*, and it becomes non-conductive. For the driving transistor 2, with the application of the high potential VdH to the image signal line Lis, a positive potential (e.g. 15+10=25 V) corresponding to the high potential VdH is applied to the third electrode (gate) 2*g*, and it becomes conductive.

Then, since the VSS line Lvs is higher in potential by Vp than the VDD line Lvd, as shown by blank arrows in FIG. 5, current flows from the VSS line Lvs to the organic EL device 1 through the second and first electrodes 2*sd* and 2*ds* of the driving transistor 2. As a result, a given amount of charge corresponding to the potential difference between the VDD line Lvd and the VSS line Lvs (e.g. charge corresponding to 7 V) is accumulated in the organic EL device 1, i.e. in the element capacitor 1*c*.

Figure 6:
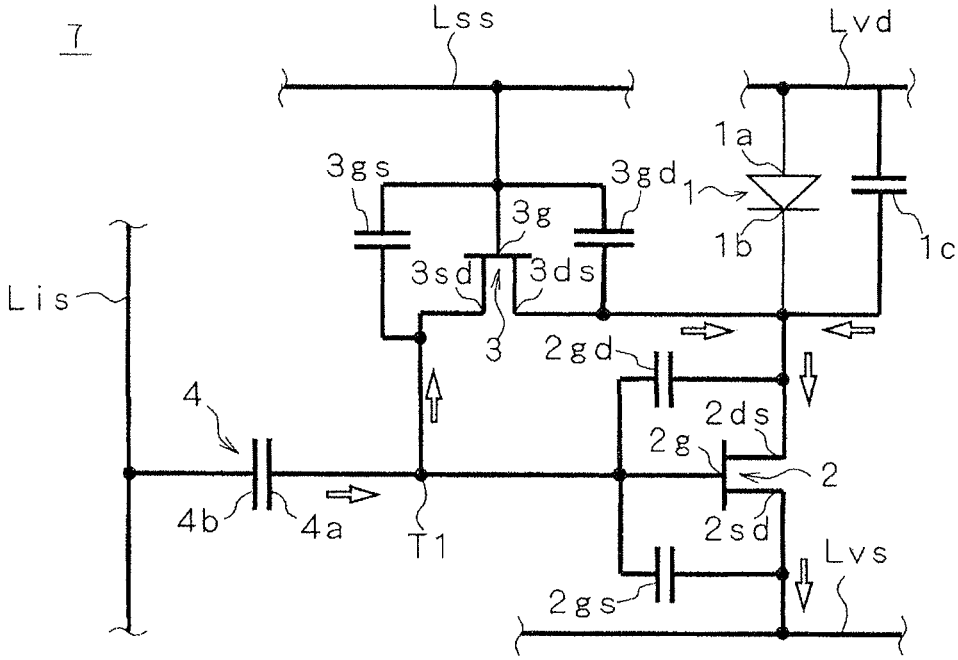
FIG. 6 is a circuit diagram illustrating the operation of the pixel circuit 7 of the technique compared with the present invention.

Vth Compensation Period P3:

FIG. 6 illustrates the flow of current in the pixel circuit 7 during the Vth compensation period P3 (hereinafter also referred to simply as "period P3").

In the period P3, a given reference potential (0 V here) is applied to the VDD line Lvd and the VSS line Lvs, the high potential VgH is applied to all scanning signal lines Lss, and the high potential Val (e.g. 10 V) is applied to the image signal line Lis.

At this time, for the Vth compensation transistor 3, with the application of the high potential VgH to the scanning signal line Lss, a positive potential corresponding to the high potential VgH is applied to the sixth electrode (gate) 3*g*, and it becomes conductive. Also, in a first part of the period P3, the driving transistor 2 becomes conductive because of the charge accumulated in the capacitor 4 and the potential Val applied to the image signal line Lis.

Accordingly, in the first part of the period P3, as shown by blank arrows in FIG. 6, current due to the charge accumulated in the capacitor 4 flows from the capacitor 4 to the fifth and fourth electrodes 3*sd* and 3*ds* of the Vth compensation transistor 3, and also flows to the VSS line Lvs through the first and second electrodes 2*ds* and 2*sd* of the driving transistor 2. Also, current due to the charge accumulated in the element capacitor 1*c* flows to the VSS line Lvs through the first and second electrodes 2*ds* and 2*sd* of the driving transistor 2.

However, as the current due to the charge accumulated in the capacitor 4 flows from the capacitor 4 to the VSS line Lvs, the charge accumulated in the capacitor 4 decreases. Then, when the potential Vgs at the third electrode 2*g* of the driving transistor 2 with respect to the second electrode 2*sd* (hereinafter also referred to as "between the third-second electrodes") decreases to the threshold Vth, the driving transistor 2 becomes non-conductive. At this time, charge corresponding to the threshold Vth is accumulated in the capacitor 4. In this way, in the period P3, charge corresponding to the threshold Vth is accumulated in the capacitor 4, and thus variations of the threshold Vth, varying among pixels, are compensated for.

Figure 7:
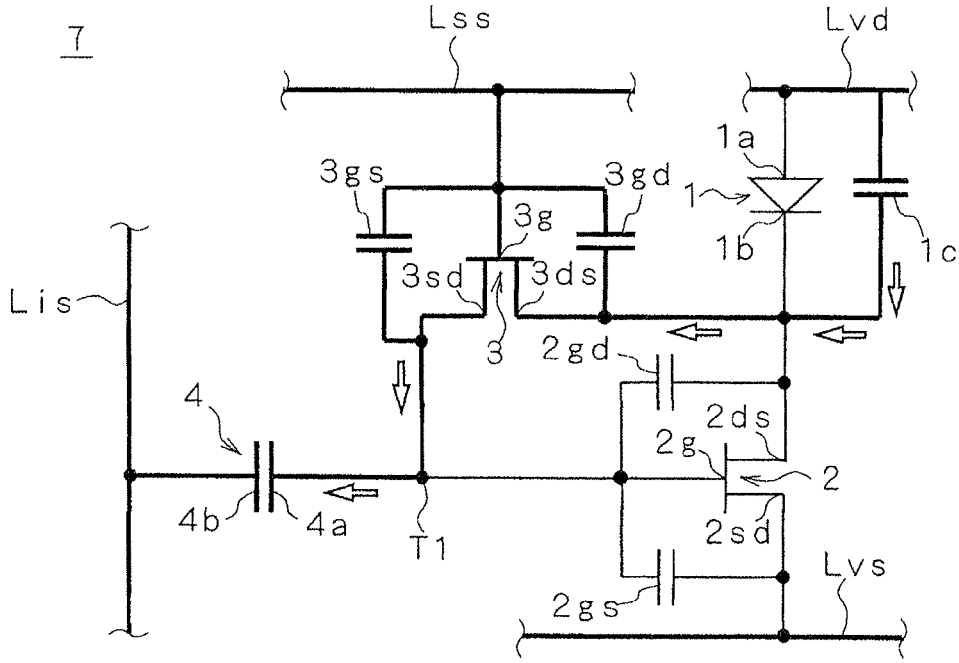
FIG. 7 is a circuit diagram illustrating the operation of the pixel circuit 7 of the technique compared with the present invention.

Writing Period P4:

FIG. 7 illustrates the flow of current in the pixel circuit 7 during the writing period P4 (hereinafter also referred to simply as "period P4").

In the period P4, the reference potential 0 V is applied to the VDD line Lvd and the VSS line Lys, the high potential VgH is applied to the scanning signal line Lss for a pixel subjected to the processing of accumulating charge in correspondence with the pixel data signal (data writing processing), and a potential (VdH-Vdata) is applied to the image signal line Lis. The potential Vdata is the potential of the pixel data signal, which is a potential corresponding to the value corresponding to the tone of the luminance of the pixel forming the image.

At this time, for the Vth compensation transistor 3, with the application of the high potential VgH to the scanning signal line Lss, a positive potential corresponding to the high potential VgH is applied to the gate, and it becomes conductive. On the other hand, for the driving transistor 2, because the potential (VdH-Vdata) below the potential VdH in the period P3 is applied to the image signal line Lis, the gate voltage goes below the threshold Vth and it becomes non-conductive.

Thus, in the period P4, as shown by blank arrows in FIG. 7, current flows from the organic EL device 1 (i.e. the element capacitor 1*c*) to the capacitor 4 through the fourth and fifth electrodes 3*ds* and 3*sd* of the Vth compensation transistor 3. As a result, the charge corresponding to the potential Vdata is added to and accumulated over the charge corresponding to the threshold Vth already accumulated in the capacitor 4. That is, in the period P4, charge corresponding to the emission luminance of the organic EL device 1 is accumulated in the capacitor 4. In other words, in the period P4, in the pixel circuit 7, charge corresponding to the pixel data signal is accumulated in the capacitor 4.

The amount of variation of the potential of the seventh electrode 4*a* of the capacitor 4 (the gate potential of the driving transistor 2) is a product of the amount of variation of the potential of the image signal line Lis and the ratio between the capacitance Cs held in the capacitor 4 and the EL device capacitance Co of the element capacitor 1*c* (capacitance ratio). That is, when the potential of the image signal line Lis varies from VdH to Vdata, the gate potential of the driving transistor 2 varies by (Vdata-VdH)·Cs/(Cs+Co). For example, when VdH=10 V, Vdata=5 V, and Cs:Co=1:2, the potential of the image signal line Lis varies by ±5 V, and the gate potential of the driving transistor 2 varies by (5-10)·1/(1+2)=−5/3 V due to the movement of charge from the organic EL device 1 to the capacitor 4. In this way, the variation of potential on the image signal line Lis is reflected to the gate potential of the driving transistor 2 because of the movement of charge accumulated in the capacitor 4.

Element Initialization Period P5:

In the element initialization period P5 (hereinafter also referred to simply as "period P5"), the given negative potential Vp is applied to the VDD line Lvd and the VSS line Lvs, the low potential VgL is applied to all scanning signal lines Lss, and the high potential VdH is applied to the image signal line Lis. At this time, the Vth compensation transistor 3 becomes non-conductive, and the driving transistor 2 becomes conductive. Then, since there is no potential difference between the VDD line Lvd and the VSS line Lvs and the VSS line Lvs is set at the negative potential −Vp, the charge accumulated in the organic EL device 1 (i.e. the element capacitor 1*c*) flows to the VSS line Lvs, and the charge accumulated in the organic EL device 1 is discharged.

Figure 8:
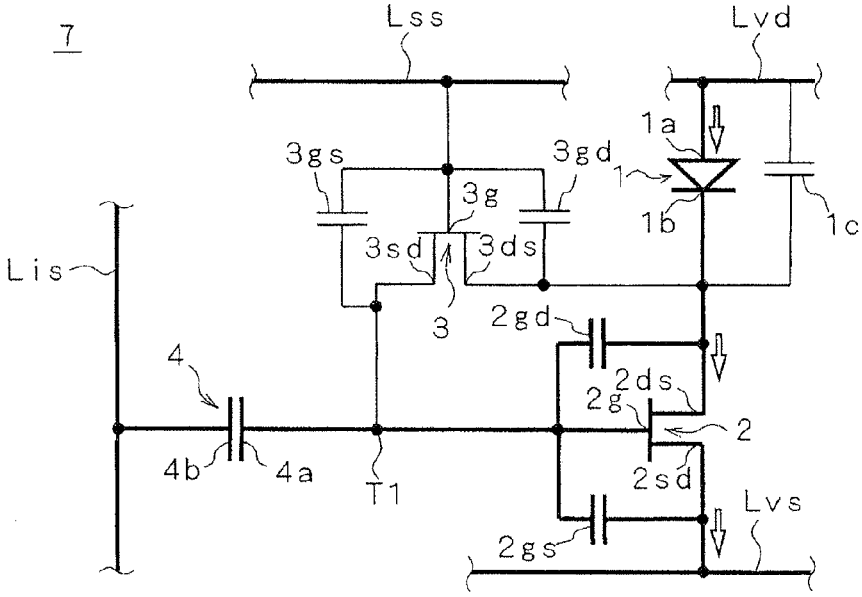
FIG. 8 is a circuit diagram illustrating the operation of the pixel circuit 7 of the technique compared with the present invention.

Light Emission Period P6:

FIG. 8 illustrates the flow of current in the pixel circuit 7 during the light emission period P6 (hereinafter also referred to simply as "period P6").

In the period P6, the positive high potential VDD is applied to the VDD line Lvd. The reference potential 0 V is applied to the VSS line Lvs. The low potential VgL is applied to the scanning signal line Lss. The high potential VdH is applied to the image signal line Lis.

At this time, because of the application of the low potential VgL to the scanning signal line Lss, the Vth compensation transistor 3 becomes non-conductive. For the driving transistor 2, due to the application of the high potential VdH to the image signal line Lis, Vgs becomes higher than the threshold Vth by the potential corresponding to the amount of charge accumulated in the capacitor 4 in the period P4 (the amount of charge corresponding to the potential Vdata), and the driving transistor 2 becomes conductive.

For example, when Vdata=5 V and Cs:Co=1:2, the charge accumulated in the capacitor 4 in the period P4 corresponds to a potential lower than the threshold Vth by 5/3 V ([Vth−5/3] V). Then, in the period P6, a potential higher than that in the period P4 by Vdata (=5 V) is applied to the image signal line Lis, and a potential higher than the threshold Vth by 10/3 V ([Vth+10/3] V=[Vth−(5/3)+5] V) is applied to the third electrode (gate) 2*g*.

Then, the VDD line Lvd is higher in potential than the VSS line Lvs by the potential VDD, and the driving transistor 2 becomes conductive where current flows between the first-second electrodes according to the potential Vdata. Accordingly, as shown by blank arrows in FIG. 8, current corresponding to the potential Vdata flows to the organic EL device 1. As a result, the organic EL device 1 emits light with luminance corresponding to the potential Vdata. That is, in the period P6, light with luminance corresponding to the pixel data signal is emitted from each pixel.

Now, about the driving transistor 2, when the organic EL device 1 emits light, Expression (1) below holds about Vgs, Vdata and Vth.

[Expression 1]

$$Vgs = Vth + a \times V\text{data} + \text{d} \quad (1)$$

In Expression (1), a and d are constants.

Also, when the current flowing between the first-second electrodes (between the drain-source) of the driving transistor 2 is represented as Ids, Expression (2) below holds.

[Expression 2]

$$Ids = (\beta/2) \times (Vgs - Vth)^2 = (\beta/2) \times (a \times V\text{data} + d)^2 \quad (2)$$

The emission luminance of the organic EL device 1 is approximately proportional to the current density flowing in the organic EL device and desired emission luminance is obtained in each pixel by the control using the driving waveforms shown in FIG. 3.

Actual luminance of the screen displayed in the image display apparatus (i.e. visually recognized luminance) is represented as the luminance in the period of time-sequential light emission multiplied by the duty (the ratio of the light emission period P6 in the period of one frame where the organic EL device 1 emits light once (hereinafter referred to as "a one-frame period"), i.e. [light emission period/one-frame period]). For example, when the luminance in the period P6 is 500 cd/m$^2$ and the duty is 0.4 (i.e. the light emission period makes up 40%), the actual luminance is 500 cd/m$^2$ multiplied by 0.4 equal to 200 cd/m$^2$.

Now, as mentioned above, the emission luminance of the organic EL device 1 is approximately proportional to the current density in the organic EL device 1, but higher current density flowing in the organic EL device 1 promotes the deterioration of the organic EL device 1, leading to shorter life of the organic EL device 1 and further to shorter life of the image display apparatus.

Now, one method for lengthening the life of the image display apparatus is to enhance the duty, intending a reduction of the current density. Then, increasing the duty requires shortening the periods P1 to P5 of one-frame period, except the period P6; however, the periods P2, P4 and P5 are already short enough, and a possible approach is to shorten the Vth compensation period P3.

However, the inventors of the present invention and others have found that simply shortening the Vth compensation period P3 causes various problems. Such problems will be described below.

Figure 9:
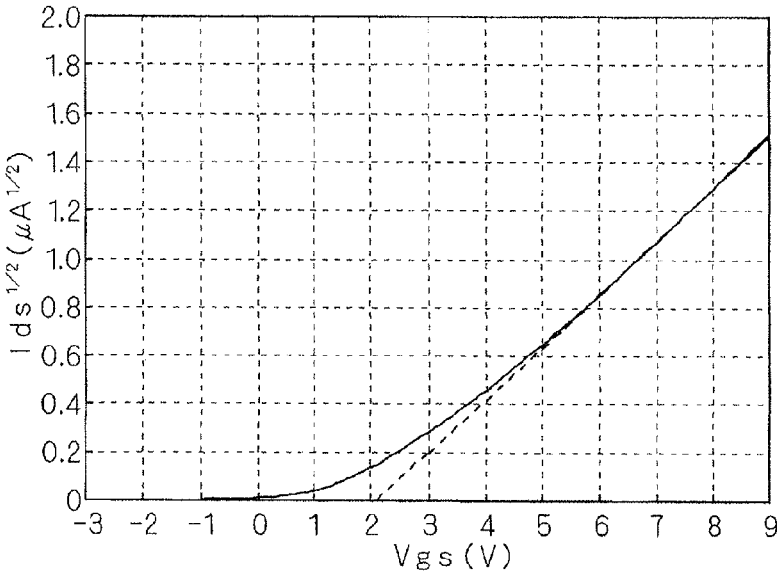
FIG. 9 is a diagram illustrating the relation between the voltage across the gate-source and the current between the drain-source in the driving transistor of the technique compared with the present invention.

FIG. 9 is a diagram illustrating a relation between the potential difference (voltage value) Vgs between the third-second electrodes (i.e. between the gate-source) of the driving transistor 2 and the current value Ids of the current flowing between the first-second electrodes (i.e. between the drain-source). In FIG. 9, the broken line shows the relation between the voltage value Vgs and the current value Ids calculated with Expression (2) above, and the solid line shows the relation between the voltage value Vgs and the current value Ids obtained by experiment.

As is clear from FIG. 9, when the voltage value Vgs is set around the threshold Vth (about 2.1 V here), the actually measured value of the current value Ids is larger than the calculated value. That is, in the driving transistor 2, a current flowing between the drain-source (hereinafter referred to as "leakage current") is generated even when voltage value Vgs=threshold Vth.

Figure 10:
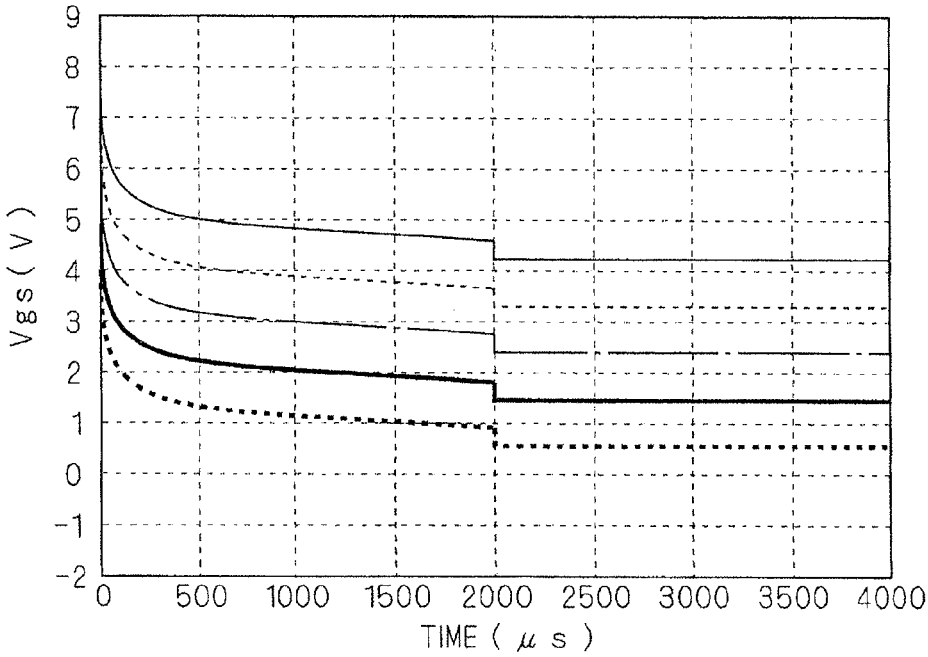
FIG. 10 is a diagram illustrating variations with time of the voltage value across the gate-source in the driving transistor that are exhibited when Vth compensation period is set at 2 ms in the technique compared with the present invention.
Figure 11:
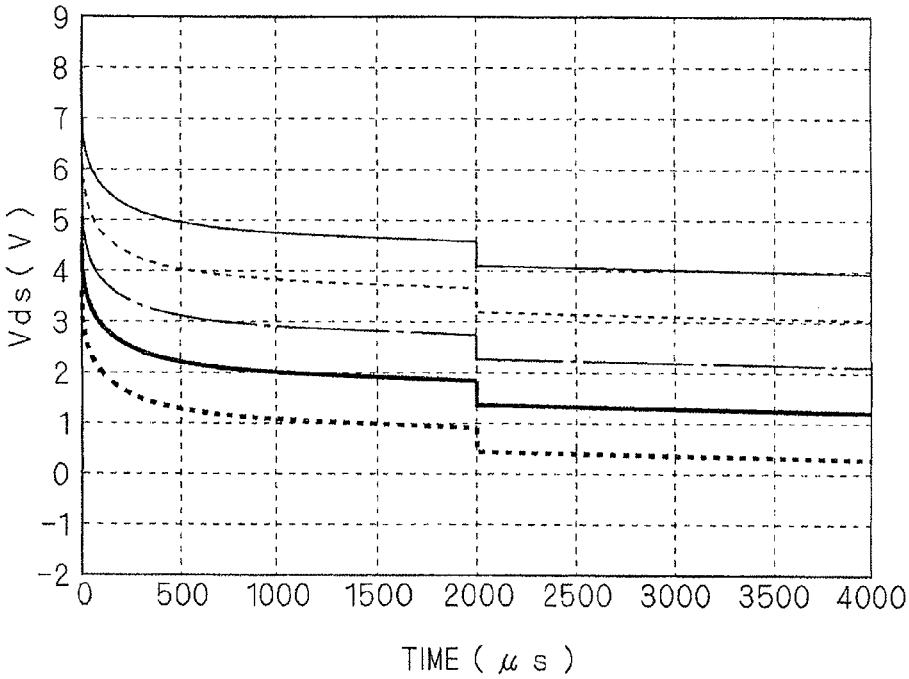
FIG. 11 is a diagram illustrating variations with time of the voltage value across the drain-source in the driving transistor that are exhibited when Vth compensation period is set at 2 ms in the technique compared with the present invention.

FIG. 10 is a diagram illustrating variations with time (actually measured values) of the potential difference (voltage value) Vgs between the gate-source of the driving transistor 2 exhibited when the Vth compensation period P3 is set to 2 milliseconds (ms), and FIG. 11 is a diagram illustrating variations with time (actually measured values) of the potential difference (voltage value) Vds between the drain-source of the driving transistor 2 exhibited when the period P3 is set to 2 ms. Adjustments were made so that the voltage values Vgs and Vds are both set at 8 V at the beginning of the period P3.

The horizontal axes in FIGS. 10 and 11 show elapsed time from the beginning of the period P3, the vertical axis in FIG. 10 shows the voltage value Vgs, and the vertical axis in FIG. 11 shows the voltage value Vds. Also, FIGS. 10 and 11 show, sequentially from top to bottom, variations with time of the voltage values Vgs and Vds in five kinds of driving transistors 2 having different thresholds Vth, including a time variation with threshold Vth=6.2 V (thin line), a time variation with threshold Vth=5.2 V (thin broken line), a time variation with threshold Vth=4.2 V (thin chain line), a time variation with threshold Vth=3.2 V (thick line), and a time variation with threshold Vth=2.2 V (thick broken line).

As shown in FIG. 10, the voltage value Vgs reached the threshold Vth at about 100 μs after the beginning of the period P3, and then gradually decreased due to the leakage current between the drain-source. Then, when the process shifts to the period P4 at 2 ms from the beginning of the period P3, in the gate potential of the driving transistor 2, a so-called punch-through due to the Vth compensation transistor 3 occurred (a phenomenon in which the potential varies with parasitic capacitance as the gate potential of the Vth compensation transistor 3 varies), and the voltage value Vgs of the driving transistor 2 rapidly dropped by about 0.3 to 0.4 V. After that, the voltage value Vgs of the driving transistor 2 was approximately fixed.

In this specification, the amount of potential variation of the gate of the driving transistor 2, which takes place when the Vth compensation transistor 3 shifts to the non-conductive state due to a variation of the gate potential of the same, is referred to as "punch-through".

The voltage value Vgs of the driving transistor 2 is held approximately constant after the shift to the period P4 because the Vth compensation transistor 3 goes into the non-conducting state where current cannot flow between the source-drain and no charge is discharged from the capacitor 4.

As to the voltage value Vds due to the charge accumulated in the organic EL device 1 (i.e. the element capacitor 1*c*) in the period P2, as shown in FIG. 11, it rapidly decreased in a first part of the period P3 (till 700 μs from the beginning), and it gradually decreased from a middle part to last part (700 μs to 2 ms) of the period P3. Then, when shifting from the period P3 to the period P4, the so-called punch-through occurred and the voltage value Vds of the driving transistor 2 rapidly decreased by about 0.5 V. After that, the voltage value Vds of the driving transistor 2 was approximately fixed.

The voltage value Vds of the driving transistor 2 is held approximately fixed after the shift to the period P4 because of the mechanism shown below. The period P3 is continued for a sufficient time period after the voltage value Vgs fell below the threshold Vth, and the voltage value Vgs of the driving transistor 2 is sufficiently lowered due to the occurrence of leakage current between the drain-source of the driving transistor 2, as shown in FIG. 9. This results in a condition where almost no leakage current occurs between the drain-source of the driving transistor 2, and so almost no charge is discharged from the element capacitor 1*c* to the VSS line Lys. Since the amount by which Vgs falls below Vth does not depend on Vth, just the same offset voltage occurs in all pixels, and there is no problem in detecting differences in Vth among pixels.

Figure 12:
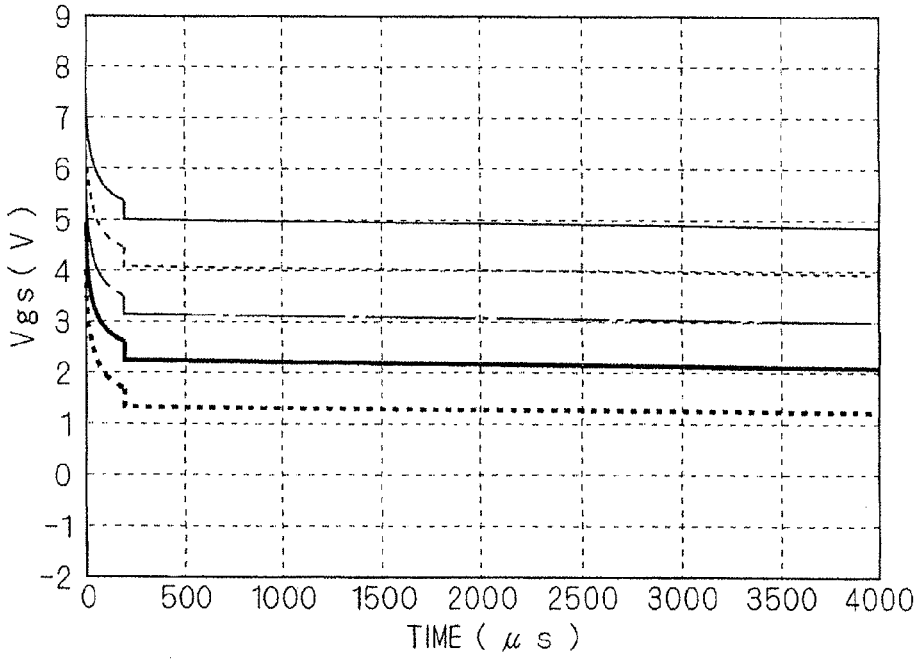
FIG. 12 is a diagram illustrating variations with time of the voltage value across the gate-source in the driving transistor that are exhibited when Vth compensation period is set at 0.2 ms in the technique compared with the present invention.
Figure 13:
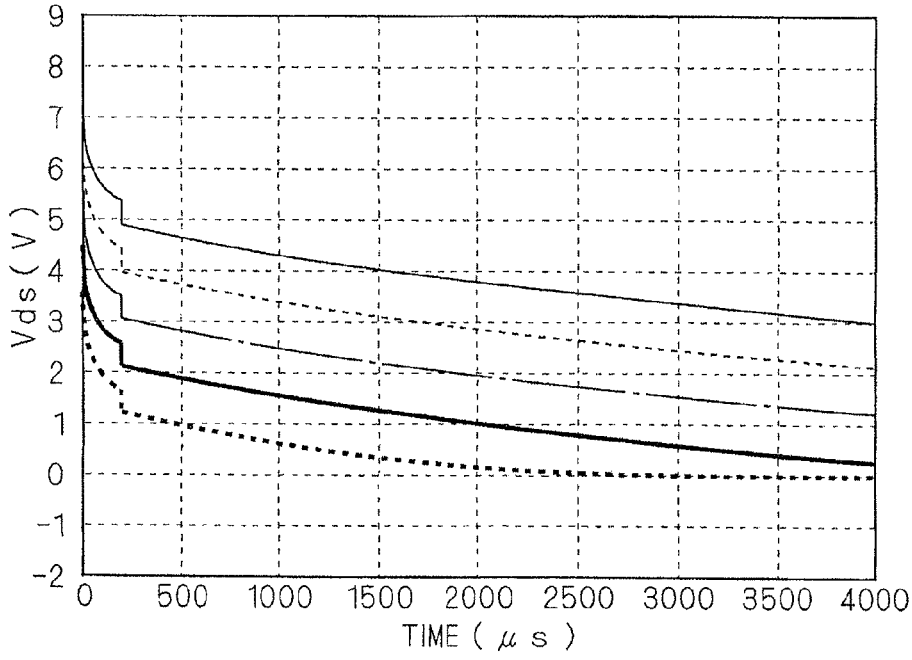
FIG. 13 is a diagram illustrating variations with time of the voltage value across the drain-source in the driving transistor that are exhibited when Vth compensation period is set at 0.2 ms in the technique compared with the present invention.

FIG. 12 is a diagram illustrating variations with time (actually measured values) of the potential difference (voltage value) Vgs between the gate-source of the driving transistor 2 exhibited when the Vth compensation period P3 is set to 0.2 millisecond (ms), and FIG. 13 is a diagram illustrating variations with time (actually measured values) of the potential difference (voltage value) Vds between the drain-source of the driving transistor 2 exhibited when the period P3 is set to 0.2 ms. Adjustments were made also here so that the voltage values Vgs and Vds are both set at 8 V at the beginning of the period P3.

As in FIGS. 10 and 11, the horizontal axes in FIGS. 12 and 13 show elapsed time from the beginning of the period P3, the vertical axis in FIG. 12 shows the voltage value Vgs, and the vertical axis in FIG. 13 shows the voltage value Vds. Also, like FIGS. 10 and 11 FIGS. 12 and 13 show, sequentially from top to bottom, variations with time of the voltage values Vgs and Vds in five kinds of driving transistors 2 having different thresholds Vth, including a time variation with threshold Vth=6.2 V (thin line), a time variation with threshold. Vth=5.2 V (thin broken line), a time variation with threshold Vth=4.2 V (thin chain line), a time variation with threshold Vth=3.2 V (thick line), and a time variation with threshold Vth=2.2 V (thick broken line).

As shown in FIG. 12, the voltage value Vgs rapidly decreases below the threshold Vth in the period P3 (elapsed time=0 to 0.2 ms). Then, when the process shifts to the period P4 at 0.2 ms from the beginning of the period P3 (elapsed time=0.2 ms), in the gate potential of the driving transistor 2, a punch-through due to the gate potential variation of the Vth compensation transistor 3 occurred, and the voltage value Vgs of the driving transistor 2 rapidly decreased by about 0.3 to 0.4 V. After that, the voltage value Vgs of the driving transistor 2 was approximately fixed.

The voltage value Vgs of the driving transistor 2 is thus held approximately constant after the shift to the period P4 because the Vth compensation transistor 3 goes into the non-conducting state where current cannot flow between the source-drain and no charge is discharged from the capacitor 4.

As shown in FIG. 13, the voltage value Vds rapidly decreases during a first part of the period P3 (elapsed time=0 to 0.2 ms), and the process shifts from the period P3 to the period P4 in the course of the rapid decrease. Then, at the shift from the period P3 to the period P4 (elapsed time=0.2 ms), a so-called punch-through occurred and the voltage value Vds of the driving transistor 2 rapidly decreased by about 0.5 V. After that, the voltage value Vds of the driving transistor 2 showed a tendency to gradually decrease as time passes.

Thus, after the shift to the period P4, the voltage value Vds of the driving transistor 2 gradually decreases as time passes because of the mechanism shown below. The period P3 is continued for just a short time after the voltage value Vgs fell below the threshold Vth, and the voltage value Vgs of the driving transistor 2 is not lowered by a sufficient amount by the leakage current between the drain-source of the driving transistor 2, and leakage current continuously occurs between the drain-source of the driving transistor 2, as shown in FIG. 9. Accordingly, charge is gradually discharged from the element capacitor 1*c* to the VSS line Lvs.

Then, the time from when the process shifts to the period. P4 to when data writing processing is performed differs depending on the position of the pixel in the image display apparatus and the method of driving the image display apparatus, and the amount of discharge of charge from the element capacitor 1*c* reaches 0.1 V or more in 300 μs from the shift to the period P4.

Thus, when the Vth compensation period P3 is simply shortened, the amount of charge discharged from the element capacitor 1*c* differs between a pixel that is subjected to data writing processing immediately after the shift to the writing period P4 and a pixel that is subjected to data writing processing after a considerable time has passed after the shift to the period P4. Accordingly, the amounts of charge accumulated in the capacitors 4 in data writing processing vary among elements, and the gate voltages of the driving transistors 2 in the light emission period P6 are shifted from desired values, and desired luminance is not obtained in the screen of the image display apparatus, resulting in unevenness of luminance.

Also, in the writing period P4, among a plurality of pixels connected in common to one image signal line Lis, the potential applied to the image signal line Lis in the data writing processing to one pixel affects other pixels not yet subjected to data writing processing.

More specifically, for example, the potential applied to the image signal line Lis is relatively low when charge corresponding to high luminance is accumulated in the capacitor 4 in one pixel, and the potential applied to the image signal line Lis is relatively high when charge corresponding to low luminance is accumulated in the capacitor 4. Thus, when high potential is applied to the image signal line Lis for one pixel, the high potential is applied to the image signal line Lis also for another pixel not yet subjected to data writing processing, and the gate voltage of the driving transistor 2 rises and leakage current is more likely to occur between the drain-source of the driving transistor 2.

As a result, desired luminance cannot be obtained when a certain or larger number of pixels emit light with low luminance in a group of pixels connected in common to one image signal line Lis. That is, belt-like unevenness (so-called cross-talk) occurs in the screen of the image display apparatus depending on the ratio of low-luminance light-emitting pixels among a plurality of pixels connected in common to one image signal line Lis.

Accordingly, the inventors of the present invention and others have devised an image display apparatus and a method for driving it where luminance unevenness and cross-talk are less likely to occur in the screen even when the Vth compensation period P3 is shortened. The apparatus and method will be described below.

First Preferred Embodiment

<Outline of Configuration of Image Display Apparatus>

Figure 14:
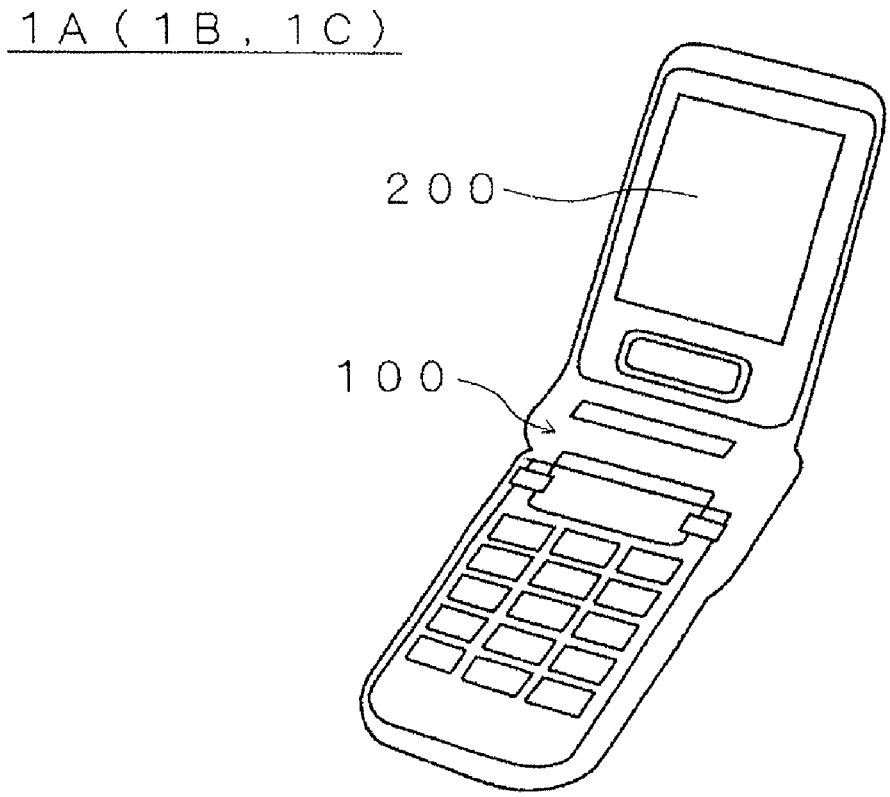
FIG. 14 is a diagram illustrating the outline configuration of an image display apparatus 1A according to a first preferred embodiment of the present invention.

FIG. 14 is a diagram illustrating the outline of the configuration of an image display apparatus according a first preferred embodiment of the present invention.

A mobile phone 1A is a portable electronic device having a display control section 100 and a display section 200, which functions as an image display apparatus that displays various kinds of images, such as moving pictures, in the display section 200. The mobile phone 1A is hereinafter referred to also as "an image display apparatus 1A".

The display control section 100 is a part that controls the image display in the display section 200 on the basis of image signal.

The display section 200 is composed of, e.g. an organic EL display (organic electroluminescence display) having approximately rectangular contours, and driver means to which various signals supplied from the display control section 100 are inputted. The organic EL display is a self-emitting type image display device having self-emitting type light-emitting elements in which current is applied to organic matter to cause the material itself to emit light.

The organic EL display has image signal lines for supplying pixels with data signal (pixel data signal) corresponding to emission luminance, and scanning signal lines arranged approximately perpendicular to the image signal lines, for supplying pixels with scanning signal. The scanning signal is a signal for controlling the timing with which the pixel signal is supplied to the pixels through the image signal lines.

The driver means has an X driver (image signal line driving circuit) electrically connected to the image signal lines, for controlling the timing with which the pixel signal is supplied to the image signal lines, and a Y driver (scanning signal line driving circuit) electrically connected to the scanning signal lines, for controlling the timing with which the scanning signal is supplied to the scanning signal lines. For example, in the mobile phone 1A, the X driver is placed along a shorter side of the organic EL display, and the Y driver is placed along a longer side of the organic EL display.

<Outline of Configuration of Display Section>

Figure 15:
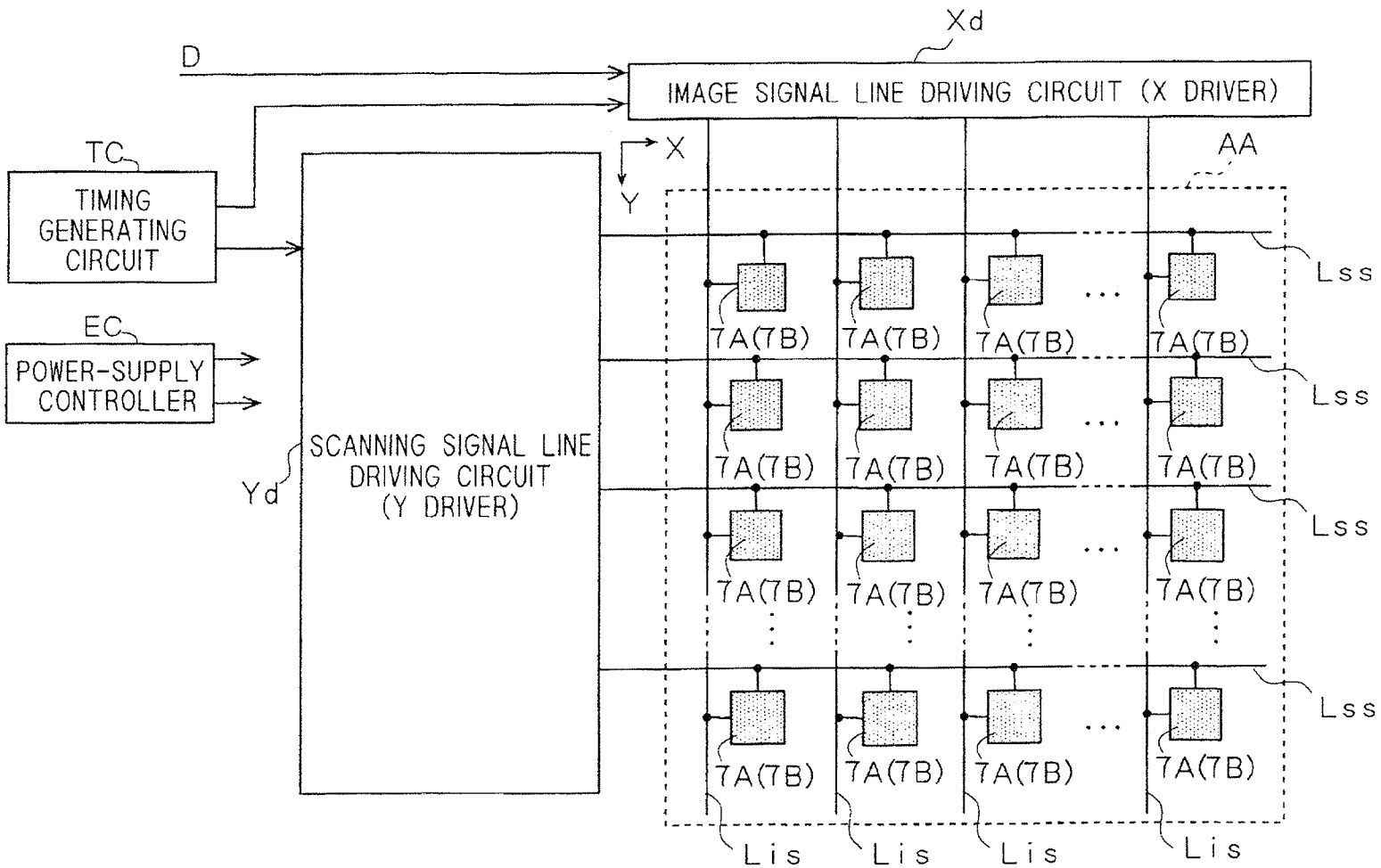
FIG. 15 is a block diagram illustrating the configuration of the display section 200 of the first preferred embodiment of the present invention.

FIG. 15 is a block diagram illustrating the outline of the configuration of the display section 200. FIG. 15 shows two perpendicular axes X and Y in order to clarify the orientation.

The display section 200 includes an organic EL display AA, a timing generating circuit TC, a power-supply controller EC, an image signal line driving circuit (X driver) Xd, and a scanning signal line driving circuit (Y driver) Yd.

The organic EL display AA has a large number of pixel circuits 7A arranged in a matrix (i.e. in a lattice-like form) along the vertical direction (Y direction) and the horizontal direction (X direction). Image signal lines Lis are provided for the respective columns of the pixel circuits 7A parallel to the Y direction, and each image signal line Lis is electrically connected in common to a plurality of pixel circuits 7A. Also, scanning signal lines Lss are provided for the respective rows of the pixel circuits 7A parallel to the X direction, and each scanning signal line Lss is electrically connected in common to a plurality of pixel circuits 7A.

The timing generating circuit TC sends to the image signal line driving circuit Xd a signal for controlling the timing with which the pixel signal is supplied to each image signal line Lis from the image signal line driving circuit Xd, in synchronization with image data (e.g. RGB pixel signal) D sent from the display control section 100, and it also sends to the scanning signal line driving circuit Yd a signal for controlling the timing with which the scanning signal is supplied to each scanning signal line Lss from the scanning signal line driving circuit Yd.

The image signal line driving circuit. Xd is responsive to the signal from the timing generating circuit TC to supply the pixel signal to the image signal lines Lis. The scanning signal line driving circuit Yd is responsive to the signal from the timing generating circuit TC to supply the scanning signal to the scanning signal lines Lss. The timing generating circuit TC thus provides control so that the pixel signal is properly supplied to each pixel circuit 7A through the image signal lines Lis.

The power-supply controller EC is a part that controls the supply of power to each pixel circuit 7A (specifically, power required for the emission of light etc.), and it may be realized by hardware, i.e. circuit configuration, or by performing software with a CPU.

<Configuration of Pixel Circuit>

Figure 16:
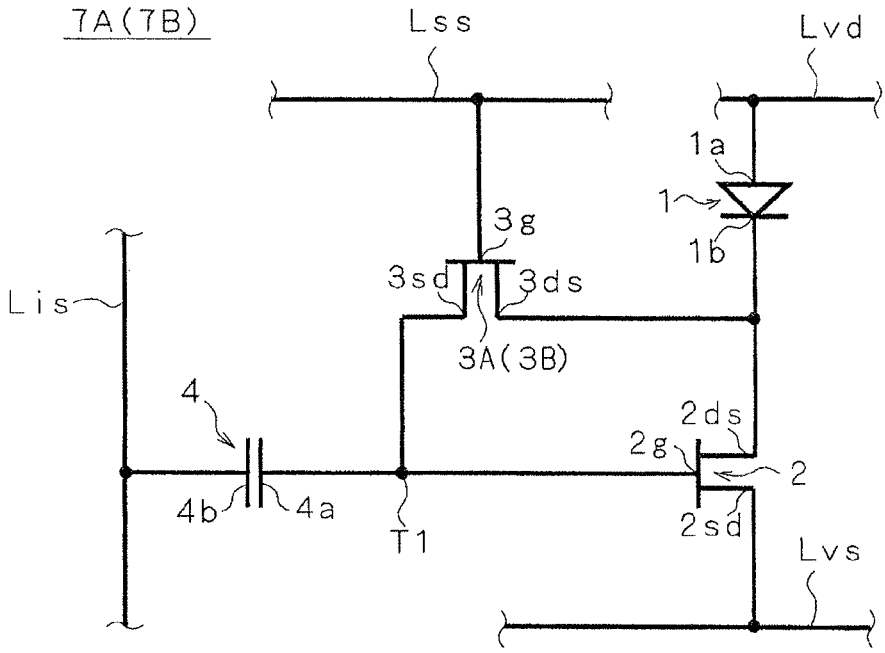
FIG. 16 is a diagram illustrating a pixel circuit 7A of the image display apparatus 1A according to the first preferred embodiment of the present invention.

FIG. 16 is a diagram illustrating the configuration of a driving circuit (pixel circuit) 7A for one pixel in the image display apparatus 1A.

In the pixel circuit 7A, the Vth compensation transistor 3 of the pixel circuit 7 of the comparative technique is replaced by a Vth compensation transistor 3A that has characteristic functions and structure of the present invention.

Now, the pixel circuit 7A of the first preferred embodiment will be described, where parts of the pixel circuit 7A that are equivalent to those of the pixel circuit 7 are shown with the same reference characters and not described here again, and differences will be described mainly.

Like the Vth compensation transistor 3 of the comparative technique, the Vth compensation transistor 3A detects the lower-limit value (threshold Vth) of the potential difference (i.e. gate voltage) between the third-second electrodes (i.e. between the gate-source) of the driving transistor 2 that allows current to flow between the first-second electrodes (i.e. between the drain-source) of the driving transistor 2, and it also adjusts the gate voltage of the driving transistor 2 to the threshold Vth. Like the Vth compensation transistor 3 of the comparative technique, the Vth compensation transistor 3A is formed of a so-called n-MISFETTFT.

Also, the Vth compensation transistor 3A is electrically connected to other parts in the same way as the Vth compensation transistor 3 of the comparative technique. Specifically, the fourth electrode 3*ds* of the Vth compensation transistor 3A is conductively connected to the interconnection that electrically connects the first electrode 2*ds* of the driving transistor 2 and the cathode electrode 1*b* of the organic EL device 1, whereby it is electrically connected to the first electrode 2*ds* of the driving transistor 2.

Also, the fifth electrode 3*sd* of the Vth compensation transistor 3A is conductively connected, at a connection point T1, to the interconnection that electrically connects the third electrode (gate) 2*g* of the driving transistor 2 and the seventh electrode 4*a* of the capacitor 4, whereby it is electrically connected to the third electrode (gate) 2*g* of the driving transistor 2. Also, the sixth electrode (gate) 3*g* of the Vth compensation transistor 3A is electrically connected to the scanning signal line Lss.

In the Vth compensation transistor 3A, a parasitic capacitance CgsTthA forms between the sixth-fifth electrodes, and a parasitic capacitance CgdTthA forms between the sixth-fourth electrodes.

Figure 17:
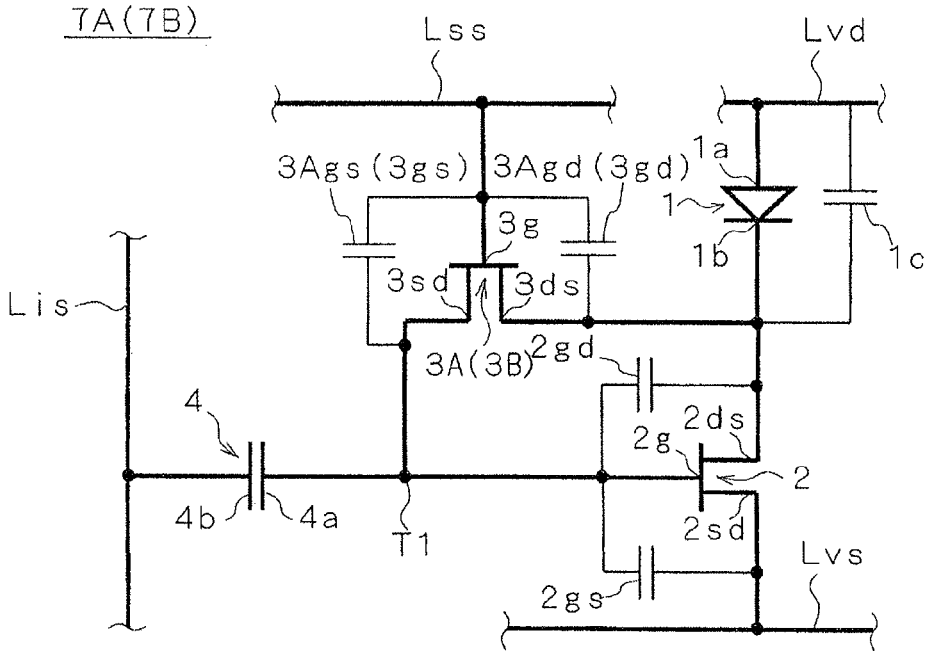
FIG. 17 is a diagram schematically illustrating parasitic capacitances generated in the pixel circuit 7A of the first preferred embodiment of the present invention.

Like FIG. 2, FIG. 17 is circuit diagram in which the circuit configuration (shown in thin line) of parasitic capacitances CgsTthA, CgdTthA, CgsTd and CgdTd and EL device capacitance Co is added to the circuit configuration of the pixel circuit 7A shown in FIG. 16 (shown in thick line).

As shown in FIG. 17, in the pixel circuit 7A, a capacitor (element capacitor) 1*c* having the EL device capacitance Co exists between the two electrodes of the organic EL device 1. A capacitor 2*gs* having the parasitic capacitance CgsTd exists between the second-third electrodes of the driving transistor 2, and a capacitor 2*gd* having the parasitic capacitance CgdTd exists between the first-third electrodes of the driving transistor 2. Also, a capacitor 3Ags having the parasitic capacitance CgsTthA exists between the fifth-sixth electrodes of the Vth compensation transistor 3A, and a capacitor 3Agd having the parasitic capacitance CgdTthA exists between the fourth-sixth electrodes of the Vth compensation transistor 3A.

In the pixel circuit 7A, unlike in the comparative technique, the relation shown by Expression (3) below is satisfied about the parasitic capacitances CgsTthA and CgdTthA of the Vth compensation transistor 3A, so that the parasitic capacitance CgsTthA is increased.

[Expression 3]

$$[CgsTthA] > [CgdTthA] \quad (3)$$

As to the method for adjustments to satisfy the relation of Expression (3), for example, in the element structure of the Vth compensation transistor 3A, the relation of Expression (3) holds when the area where the fifth electrode 3*sd* and the sixth electrode 3*g* face each other is larger than the area where the fourth electrode 3*ds* and the sixth electrode 3*g* face each other.

For example, when the area where the fifth electrode 3*sd* and the sixth electrode 3*g* face each other is twice or more larger than the area where the fourth electrode 3*ds* and the sixth electrode 3*g* face each other, the parasitic capacitance CgsTthA can be set at a sufficiently large value that is twice or more larger than the parasitic capacitance CgdTthA.

Now, examples will be described where the parasitic capacitances CgsTth and CgdTth of the comparative technique are both set at 3.6 femtofarads (fF), and the parasitic capacitance CgdTthA of this preferred embodiment is set at 3.6 fF, and the parasitic capacitance CgsTthA is set at 18 fF, which is five times the parasitic capacitance CgsTth.

<Driving Method>

Figure 18:
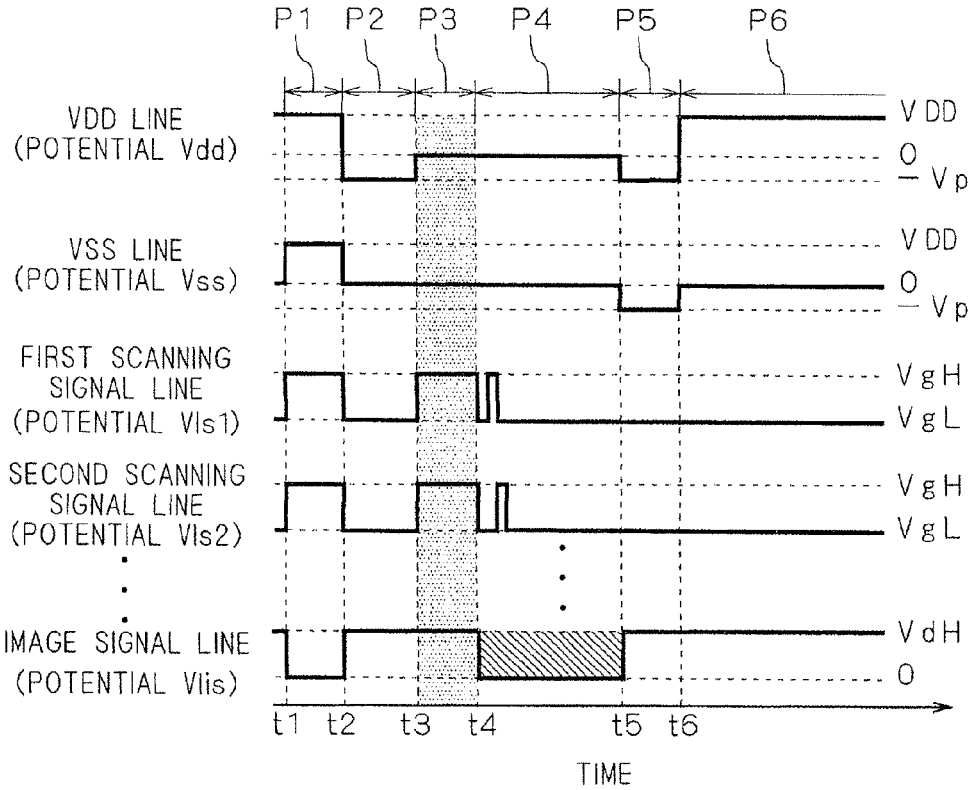
FIG. 18 is a timing chart illustrating driving waveforms for the pixel circuit 7A of the first preferred embodiment of the present invention.

FIG. 18 is a timing chart illustrating signal waveforms (driving waveforms) for driving the image display apparatus 1A. In FIG. 18, as in FIG. 3, the horizontal axis shows time, and the waveforms shown sequentially from top to bottom are (a) the potential applied to the VDD line Lvd (potential Vdd), (b) the potential applied to the VSS line Lvs (potential Vss), (c) the potential of signal applied to a first scanning signal line Lss (potential Vls1), (d) the potential of signal applied to a second scanning signal line Lss (potential Vls2), and (e) the potential of signal applied to the image signal line Lis (potential Vlis).

Like FIG. 3, FIG. 18 shows driving waveforms for causing the organic EL device 1 to emit light once, and the period of one light emission includes, in time sequential order, Cs initialization period P1 (time t1 to t2), preparatory period P2 (time t2 to t3), Vth compensation period P3 (time t3 to t4), writing period P4 (time t4 to t5), element initialization period P5 (time t5 to t6), and light emission period P6 (time from t6). The potential Vlis in the writing period P4 is an arbitrary value that is determined by the emission luminance of each organic EL device 1, and therefore, in FIG. 18, as in FIG. 3, the range where the potential can exist is shown by oblique hatching for the sake of convenience.

When the image display apparatus 1A is driven (specifically, in the periods P1 to P6), the flow of current in the pixel circuit 7A is similar to that in the pixel circuit 7 of the comparative technique (i.e. the flow of current shown in FIGS. 4 to 8), which will therefore not be described again here. The application of voltage across the VDD line Lvd and the VSS line Lvs, i.e. the supply of power (feeding) to the pixel circuit 7A, is controlled by the power-supply controller EC.

Also, the potentials applied to the individual parts during the periods P1 to P6 shown in FIG. 18 are the same as those shown in FIG. 3, which will therefore not be described again here.

It should be noted that, as to the lengths of the periods P1 to P6 shown in FIG. 18, only the Vth compensation period P3 (the period of time t3 to t4 shaded with dots in FIG. 18) is shorter than the period P3 shown in FIG. 3.

Specifically, the period P1 (time t1 to t2) shown in FIG. 18 has the same length as the period P1 (time t11 to t12) shown in FIG. 3, the period P2 (time t2 to t3) shown in FIG. 18 has the same length as the period P2 (time t12 to t13) shown in FIG. 3, the period P4 (time t4 to t5) shown in FIG. 18 has the same length as the period P4 (time t14 to t15) shown in FIG. 3, and the period P5 (time t5 to t6) shown in FIG. 18 has the same length as the period P5 (time t15 to t16) shown in FIG. 3, while the Vth compensation period P3 (time t3 to t4) shown in FIG. 18 is shorter than the period P3 (time t13 to t14) shown in FIG. 3. For example, the period P3 shown in FIG. 3 can be 2 ms, and the period P3 shown in FIG. 18 can be 0.2 ms.

<Shortening of Vth Compensation Period and its Effects>

Figure 19:
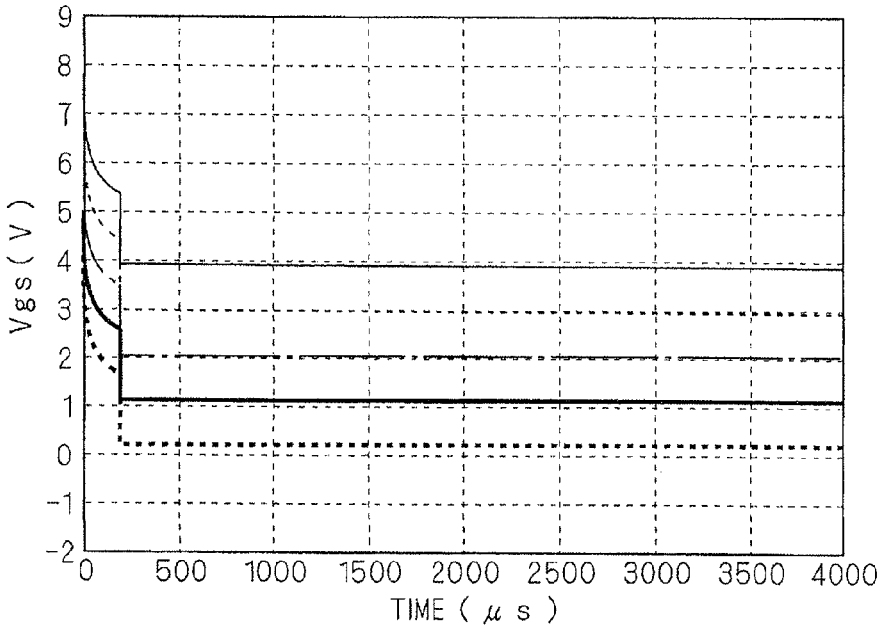
FIG. 19 is a diagram illustrating variations with time of the gate-source voltage of the driving transistor of the first preferred embodiment of the present invention.
Figure 20:
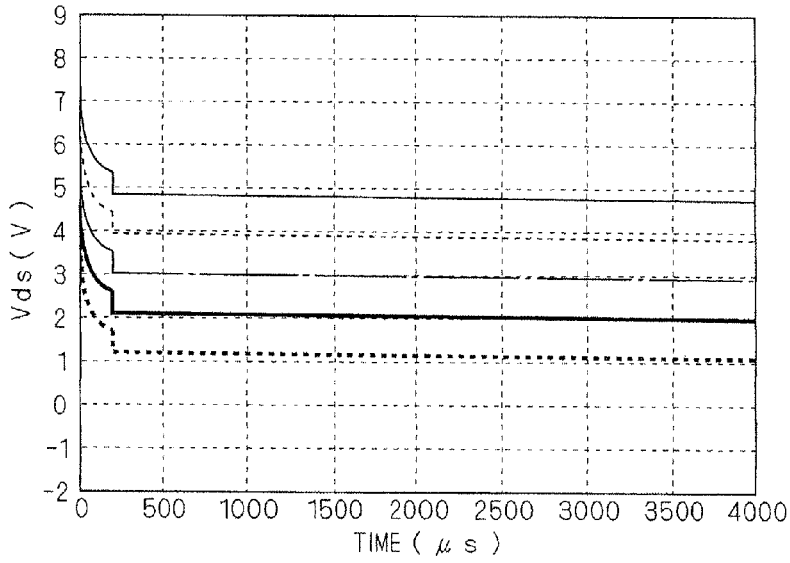
FIG. 20 is a diagram illustrating variations with time of the drain-source voltage of the driving transistor of the first preferred embodiment of the present invention.

FIG. 19 is a diagram illustrating variations with time (actually measured values) of the potential difference (voltage value) Vgs between the third-second electrodes (i.e. between the gate-source) of the driving transistor 2 exhibited when the Vth compensation period P3 is set to 0.2 ms, and FIG. 20 is a diagram illustrating variations with time (actually measured values) of the potential difference (voltage value) Vds between the first-second electrodes (i.e. between the drain-source) of the driving transistor 2 exhibited when the period P3 is set to 0.2 ms. Adjustments were made so that the voltage values Vgs and Vds are both set at 8 V at the beginning of the period P3.

As in FIGS. 10 and 11, the horizontal axes in FIGS. 19 and 20 show elapsed time from the beginning of the period P3, the vertical axis in FIG. 19 shows the voltage value Vgs, and the vertical axis in FIG. 20 shows the voltage value Vds.

Also, like FIGS. 10 and 11, FIGS. 19 and 20 show, sequentially from top to bottom, variations with time of the voltage values Vgs and Vds in five kinds of driving transistors 2 having different thresholds Vth, including a time variation with threshold Vth=6.2 V (thin line), a time variation with threshold Vth=5.2 V (thin broken line), a time variation with threshold Vth=4.2 V (thin chain line), a time variation with threshold Vth=3.2 V (thick line), and a time variation with threshold Vth=2.2 V (thick broken line).

As shown in FIG. 19, the voltage value Vgs rapidly decreases below the threshold Vth in the period P3 (elapsed time-0 to 0.2 ms). Then, when the process shifts to the period P4 (elapsed time=0.2 ms), in the gate potential of the driving transistor 2, a punch-through due to the gate potential variation of the Vth compensation transistor 3A occurred, and the voltage value Vgs of the driving transistor 2 rapidly decreased by 1V or more. After that, the voltage value Vgs of the driving transistor 2 was approximately fixed.

The voltage value Vgs of the driving transistor 2 is thus held approximately constant after the shift to the period P4 because the Vth compensation transistor 3A goes into the no-conducting state in which current cannot flow between the fourth-fifth electrodes (i.e. between the drain-source) and no charge is discharged from the capacitor 4.

Next, as shown in FIG. 20, the voltage value Vds rapidly decreases in the period P3 (elapsed time=0 to 0.2 ms), and the process shifts from the period P3 to the period P4 in the course of the rapid decrease. Then, at the shift from the period P3 to the period P4 (elapsed time=0.2 ms), a so-called punch-through occurred and the voltage value Vds of the driving transistor 2 rapidly decreased by about 0.5 V. After that, the voltage value Vds of the driving transistor 2 was approximately constant.

The phenomenon in which the voltage value Vds of the driving transistor 2 is thus held approximately constant after the shift to the period P4 occurs because of the mechanism shown below. As shown in FIG. 19, the amount by which the voltage value Vgs of the driving transistor 2 rapidly decreases (for example, 1 V or more) due to the punch-through when the process shifts from the period P3 to the period. P4 is twice or more larger than the amount by which the voltage value Vgs of the driving transistor 2 rapidly decreases (for example, about 0.3 to 0.4 V) due to the punch-through in the comparative technique shown in FIGS. 10 and 12, whereby the voltage value Vgs of the driving transistor 2 is sufficiently lowered. As a result, the driving transistor 2 goes into a state where almost no leakage current occurs between the source-drain, and almost no charge is discharged from the element capacitor 1c to the VSS line Lys.

Now, the reason will be described for which the amount of rapid decrease of the voltage value Vgs of the driving transistor 2 due to the punch-through is increased.

The voltage of punch-through of the gate voltage (voltage value Vgs) of the driving transistor 2 due to the Vth compensation transistor 3A (punch-through voltage, i.e. the amount of potential variation with parasitic capacitance when the gate voltage varies) MV is given by Expression (4) below with the high potential VgH and low potential VgL of the gate potential of the Vth compensation transistor 3A.

[Expression 4]

$$MV=CgsTthAx(VgL-VgH)/(Cs+CgsTthA+CgdTd+CgsTd) \quad (4)$$

As described above, the relation given by Expression (3) is satisfied about the parasitic capacitances CgsTthA and CgathA of the Vth compensation transistor 3 of this preferred embodiment, whereby the parasitic capacitance CgsTthA is increased. Then, as shown by Expression (4) when the absolute value of the punch-through voltage increases as the parasitic capacitance CgsTthA is increased, the gate voltage (voltage Vgs) of the driving transistor 2 rapidly decreases by a larger amount when the process moves from the period P3 to the period P4.

When the amount of rapid decrease of the voltage value Vgs of the driving transistor 2 is thus increased, the driving transistor 2 goes into the non-conducting state where current cannot sufficiently flow between the source-drain. Accordingly, even when the period P3 is shortened, the amount of charge discharged from the element capacitor 1c hardly differs between a pixel that is subjected to data writing processing immediately after the shift to the period P4 and a pixel that is subjected to data writing processing after a considerable time has passed after the shift to the period P4. This makes it possible to shorten the Vth compensation period P3, while suppressing luminance unevenness and cross-talk on the screen.

For example, the period P3 can be considerably shortened by 1.8 ms from 2 ms to 0.2 ms, and this time period (1.8 ms) can be utilized to prolong the period P6, whereby, when the duty of the comparative technique is 30%, the duty can be considerably increased to 40.8%. This increase in duty offers enhanced visible emission luminance, making it possible to reduce the current density required to realize the same emission luminance.

As described so far, in the image display apparatus 1A of the first preferred embodiment, the parasitic capacitance CgsTthA between the fifth-sixth electrodes of the Vth compensation transistor 3A is set to be a larger value than the parasitic capacitance CgdTthA between the fourth-sixth electrodes. This structure increases the amount of variation of the gate potential of the driving transistor 2 that occurs when the Vth compensation transistor 3A changes from the conducting state to the non-conducting state, whereby the driving transistor 2 goes into the non-conducting state even when the Vth compensation period P3 is shortened. As a result, even when the Vth compensation period P3 is shortened, almost no differences occur in the amount of reduction of charge accumulated in the organic EL device 1 before charge corresponding to the image data signal is accumulated in individual pixels during the writing period P4. This makes it possible to lengthen the life of the image display apparatus 1A while suppressing luminance unevenness and cross-talk on the screen.

Also, when the parasitic capacitance CgsTthA is set sufficiently larger, twice or more, than the parasitic capacitance CgdTthA, the gate potential of the driving transistor 2 varies by a considerably increased amount when the Vth compensation transistor 3A changes from the conducting state to the non-conducting state. Accordingly, even when the Vth compensation period P3 is further shortened, the driving transistor 2 can easily go into the non-conducting state when the process moves to the writing period P4. This makes it possible to further prolong the life of the image display apparatus 1A while suppressing luminance unevenness and cross-talk on the screen.

Second Preferred Embodiment

In the image display apparatus 1A of the first preferred embodiment, the parasitic capacitance CgsTthA of the Vth compensation transistor 3A is set at a larger value than the parasitic capacitance CgdTthA so that the gate potential of the driving transistor 2 is lowered by an increased amount when the Vth compensation transistor 3A changes from the conducting state to the non-conducting state, whereby, even when the period P3 is shortened, the driving transistor 2 can easily go into the non-conducting state when the process shifts to the period P4. On the other hand, in an image display apparatus 1B of the second preferred embodiment, the potential of the signal applied to the image signal line Lis is appropriately adjusted so that the driving transistor 2 goes into the non-conducting state at the shift to the period P4, even when the period P3 is shortened.

Now, the image display apparatus 1B of the second preferred embodiment will be described.

In the description below, parts, periods and potentials similar to those of the first preferred embodiment are shown with the same reference characters and not described again here, and differences will be described mainly.

Figure 21:
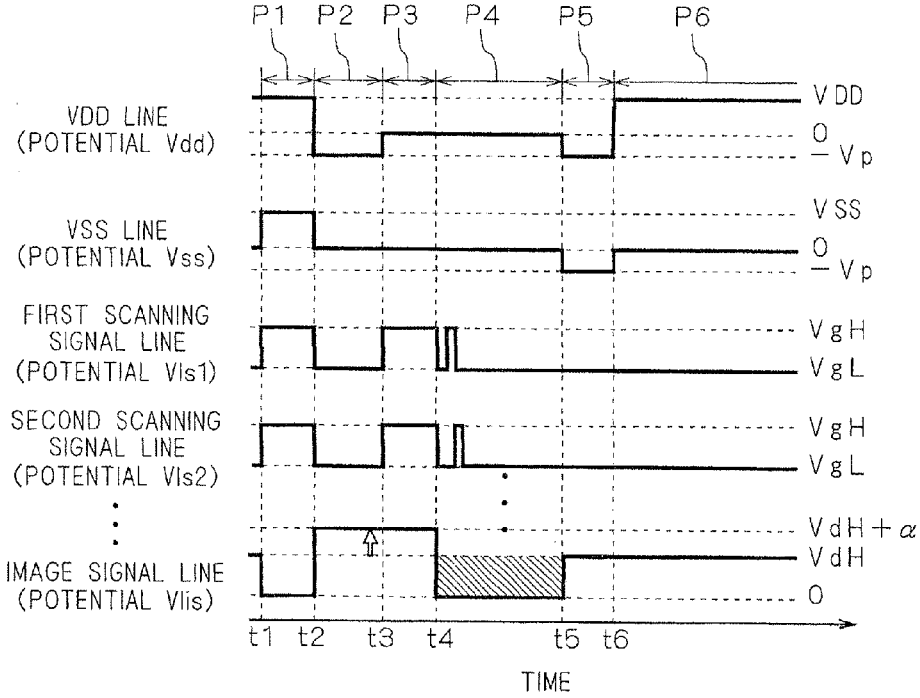
FIG. 21 is a timing chart illustrating driving waveforms according to a second preferred embodiment of the present invention.

FIG. 21 is a timing chart illustrating signal waveforms (driving waveforms) for driving the image display apparatus 1B. In FIG. 21, as in FIGS. 3 and 18, the horizontal axis shows time, and the waveforms shown sequentially from top to bottom are (a) the potential applied to the VDD line Lvd (potential Vdd), (b) the potential applied to the VSS line Lvs (potential Vss), (c) the potential of signal applied to the first scanning signal line Lss (potential Vls1), (d) the potential of signal applied to the second scanning signal line Lss (potential Vls2), and (e) the potential of signal applied to the image signal line Lis (potential Vlis).

Like FIGS. 3 and 18, FIG. 21 shows driving waveforms for causing the organic EL device 1 to emit light once, and the period of one light emission includes, in time sequential order, Cs initialization period P1 (time t1 to t2), preparatory period P2 (time t2 to t3), Vth compensation period P3 (time t3 to t4), writing period P4 (time t4 to t5), element initialization period P5 (time t5 to t6), and light emission period P6 (time from t6). The potential Vlis in the writing period P4 is an arbitrary value that is determined by the emission luminance of each organic EL device 1, and therefore, in FIG. 21, as in FIGS. 3 and 18, the range where the potential can exist is obliquely hatched for the sake of convenience.

In the driving waveforms shown in FIG. 21, the four potentials Vdd, Vss, Vls1, and Vls2 show the same potential waveforms as those shown in FIG. 18.

On the other hand, as to the potential (potential Vlis) applied to the image signal line Lis, the waveform differs from that shown in FIG. 18 in that the potential in time t2 to t4, i.e. in the periods P2 and P3, is set higher by a certain value a to VdH+$\alpha$, and the potential waveform is set in the same way in other respects.

When the potential Vlis in the periods P2 and P3 is thus set higher than the given high potential VdH by the given value $\alpha$, the eighth electrode 4*h* of the capacitor 4 is also set to the potential VdH+$\alpha$, whereby, in the period P3, the charge accumulated in the capacitor 4 is discharged to the VSS line Lvs faster and by a larger amount. Accordingly, even when the period P3 is shortened, the gate voltage Vgs of the driving transistor 2 is sufficiently lowered, and therefore, in the period P4, the driving transistor 2 goes into a state where almost no leakage current occurs between the first-second electrodes. As a result, in the period P4, charge is less likely to be discharged from the element capacitor 1*c* to the VSS line Lvs in pixels that have not yet been subjected to data writing processing.

Seen from another aspect, the potential Vlis in the period P3 is set higher than the maximum value of the potential Vlis in the period P4. When the potential is set in this way, in the period P4, when data writing processing is applied to one pixel among a plurality of pixels connected in common to the same image signal line Lis, leakage current is less likely to occur in driving transistors 2 in the other pixels.

By the way, in the driving waveforms shown in FIG. 21, the potential Vlis is lowered to 0 V at approximately the same time (time t4) as the Vth compensation transistor 3B goes into the non-conducting state when the process moves from the period P3 to the period P4. It is preferable to consider the following point about the relation between the timing with which the Vth compensation transistor 3B is placed into the non-conducting state and the timing with which the potential Vlis (i.e. the potential applied to the eighth electrode 4*b*) is lowered.

For example, it is preferable to lower the potential Vlis after the Vth compensation transistor 3B has been placed in the non-conducting state. This is because, if some period exists before the Vth compensation transistor 3B is placed in the non-conducting sate after the potential Vlis is lowered, charge is accumulated in the capacitor 4 in this period and it hinders the lowering of the gate voltage Vgs of the driving transistor 2. However, from the aspect of shortening the period P3, it is preferable to set as short as possible the period from when the Vth compensation transistor 3B is placed in the non-conducting state to when the potential Vlis is lowered. That is, it is most preferable to set the same the timing with which the Vth compensation transistor 3B is placed in the non-conducting state and the timing with which the potential Vlis is lowered.

While the potential Vlis is set higher by a than VdH in the periods P2 and P3, the amount of increase "$\alpha$" of potential can be set as follows, for example.

For example, when the threshold voltage Vth=2.2 V, and when, as shown in FIG. 10, the period P3 is set at 2 ms and the gate voltage Vgs of the driving transistor 2 is lowered to about 0.9 V in the period P3, then, as shown in FIG. 11, the driving transistor 2 goes into the non-conducting state in the period P4. On the other hand, when, as shown in FIG. 12, the period P3 is shortened to 0.2 ms and the gate voltage Vgs of the driving transistor 2 is lowered only to about 1.7 V in the period P2, then, as shown in FIG. 13, leakage current occurs in the driving transistor 2 in the period P4. Considering this, the period P3 can be shortened to 0.2 ms when the amount of charge accumulated in the capacitor 4 at the end of the period P3 is lowered by about 0.8 (=1.7-0.9) V. More specifically, the amount of increase a of the potential can be set on the basis of the ratio (capacitance ratio) of the capacitance of the capacitor 4 in the capacitance of the capacitor 4 and other capacitors.

In this way, in the image display apparatus 1B of the second preferred embodiment, the potential Vlis in the period P3 (potential VdH+α here) is set higher than the maximum value of the potential Vlis in the period P4 (potential VdH here), With this configuration, even when the period P3 is shortened, the driving transistor 2 goes into the non-conducting state where leakage current hardly occurs when the Vth compensation transistor 3A changes from the conducting state to the non-conducting state. As a result, even when the period P3 is shortened, almost no differences occur in the amount of decrease of the charge accumulated in the organic EL, device 1 before charge corresponding to the pixel data signal is accumulated in individual pixels during the period P4. This makes it possible to lengthen the life of the image display apparatus while suppressing luminance unevenness and cross-talk on the screen.

Also, it can be said that the image display apparatus 1B of the second preferred embodiment is more preferable to the image display apparatus 1A of the first preferred embodiment in the following aspects.

The Vth compensation transistor 3B is not larger-sized due to increased overlap for enlarging the parasitic capacitance VgsTth. That is, as compared with the image display apparatus 1A of the first preferred embodiment, the image display apparatus 1B of the second preferred embodiment can adopt a simpler structure for the pixel circuit 713, though it requires altering the circuit for adjusting the potential Vlis. This is more preferable because this does not lower the degree of freedom of design, e.g. this does not reduce the areas for the formation of the driving transistor 2 and the capacitor 4 that are important to adjust the emission luminance of the organic EL device 1.

Also, precisely adjusting the potential Vlis is easier than precisely adjusting the overlap in the Vth compensation transistor 3A. Furthermore, this is preferable also in that the potential Vlis can be adjusted after the pixel circuit 713 has been formed.

Third Preferred Embodiment

In the image display apparatus 1B of the second preferred embodiment, the potential Vlis (i.e. the potential of the eighth electrode 4*b* of the capacitor 4) is appropriately adjusted so that, even when the period P3 is shortened, the driving transistor 2 goes into the non-conducting state when the process shifts to the period P4. On the other hand, in an image display apparatus 1C of a third preferred embodiment, the potential applied to the VSS line Lvs (i.e. the potential applied to the second electrode 2*sd* of the driving transistor 2) is appropriately adjusted so that, even when the period P3 is shortened, the driving transistor 2 goes into the non-conducting state when the process shifts to the period P4.

Now, the image display apparatus 1C of the third preferred embodiment will be described.

In the description below, parts, periods and potentials similar to those in the first and second preferred embodiments are shown with the same reference characters and not described again here, and differences will be described mainly.

Figure 22:
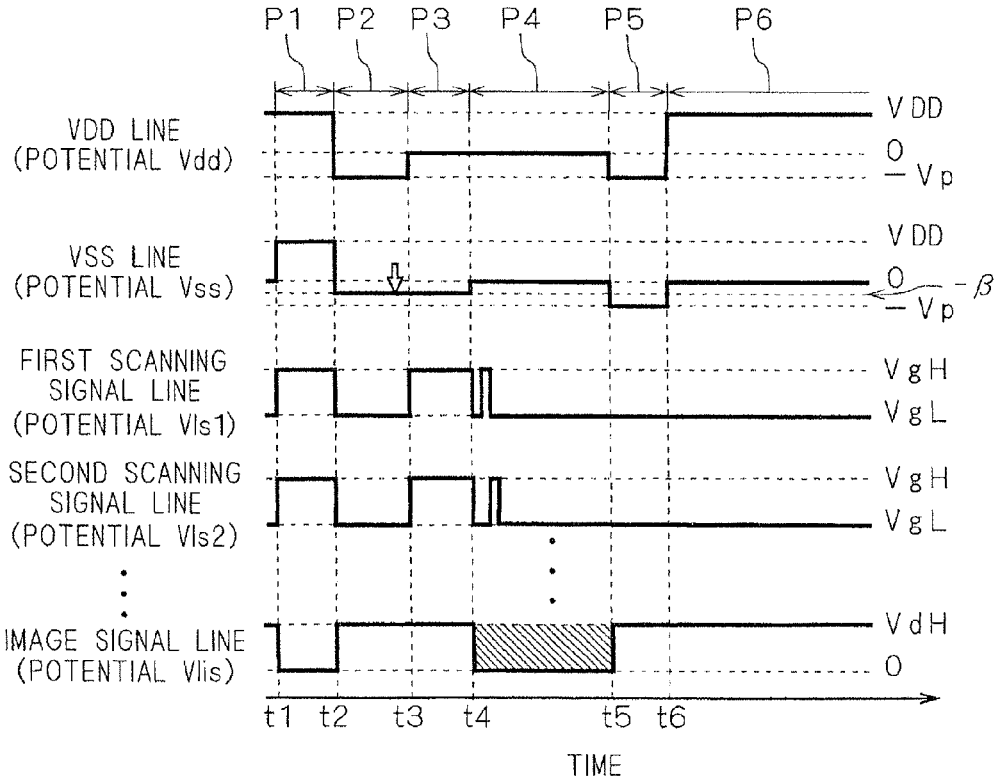
FIG. 22 is a timing chart illustrating driving waveforms according to a third preferred embodiment of the present invention.

FIG. 22 is a timing chart illustrating signal waveforms (driving waveforms) for driving the image display apparatus 1C. In FIG. 22, as in FIGS. 3, 18 and 21, the horizontal axis shows time, and the waveforms shown sequentially from top to bottom are (a) the potential applied to the VDD line Lvd (potential Vdd), (b) the potential applied to the VSS line Lvs (potential Vss), (c) the potential applied to the first scanning signal line Lss (potential Vls1), (d) the potential applied to the second scanning signal line Lss (potential Vls2), and (e) the potential applied to the image signal line Lis (potential Vlis).

Like FIGS. 3, 18 and 21, FIG. 22 shows driving waveforms for causing the organic EL device 1 to emit light once, and the period of one light emission includes, in time sequential order, Cs initialization period P1 (time t1 to t2), preparatory period P2 (time t2 to t3), Vth compensation period P3 (time t3 to t4), writing period P4 (time t4 to t5), element initialization period P5 (time t5 to t6), and light emission period P6 (time from t16). The potential Vlis in the period P4 is an arbitrary value that is determined by the emission luminance of each organic EL device 1, and therefore, in FIG. 22, as in FIGS. 3, 18 and 21, the range where the potential Vlis can exist is shown with oblique hatching for the sake of convenience.

In the driving waveforms shown in FIG. 22, the four potentials Vdd, Vls1, Vls2 and Vlis are the same potential waveforms as those shown in FIG. 18. On the other hand, as to the potential (potential Vss) applied to the VSS line Lvs, as compared with that shown in FIG. 18, the potential in time t2 to t4, i.e. in the periods P2 and P3, is set lower by a certain value β to −β, and the potential waveform is the same in other respects.

In this way, when the potential Vss in the periods P2 and P3 is set lower by β than 0 V, in the period P3, the charge accumulated in the capacitor 4 is discharged to the VSS line Lvs faster and by a larger amount. Accordingly, even when the period P3 is shortened, the gate voltage Vgs of the driving transistor 2 is sufficiently lowered. Accordingly, in the period P4, the driving transistor 2 goes into a state where almost no leakage current occurs between the first-second electrodes (i.e. between the drain-source). As a result, in the period P4, charge is less likely to be discharged from the element capacitor 1*c* to the VSS line Lvs in pixels that have not yet been subjected to data writing processing.

Also, seen from the aspect of control of the potential Vss from the period P3 to the period P4, a first potential (−β here) is applied to the VSS line Lvs in a period in which the Vth compensation transistor 3B is placed in the conducting state. Then, with approximately the same timing with which the Vth compensation transistor 3B changes from the conducting state to the non-conducting state, the potential Vss is brought from the first potential to a second potential (0 V here) that is relatively higher than the first potential.

By the way, in the driving waveforms shown in FIG. 22, the potential Vss is raised from −β to 0 V at approximately the same time (time t4) as the Vth compensation transistor 3B goes into the non-conducting state when the process moves from the period P3 to the period P4. It is preferable to consider the following point about the relation between the timing with which the Vth compensation transistor 3B is placed into the non-conducting state and the timing with which the potential Vss (i.e. the potential at the second electrode 2*sd* of the driving transistor 2) is raised.

It is preferable to raise the potential. Vss after the Vth compensation transistor 3B has been placed in the non-conducting state. This is because, if some period exists before the Vth compensation transistor 3B is placed in the non-conducting state after the potential Vss is raised, charge is accumulated in the capacitor 4 in this period and it hinders the lowering of the gate voltage Vgs of the driving transistor 2. However, from the aspect of shortening the period P3, it is preferable to set as short as possible the period from when the Vth compensation transistor 3B is placed in the non-conducting state to when the potential Vss is raised. That is, it is most preferable to set the same the timing with which the Vth compensation transistor 3B is placed in the non-conducting state and the timing with which the potential Vss is raised.

As to the amount of decrease "β" of the potential Vss, as described in the second preferred embodiment, when the threshold voltage Vth=2.2 V, for example, the period P3 can be shortened to 0.2 ms when the amount of charge accumulated in the capacitor 4 at the end of the period P3 is lowered by about 0.8 (=1.7-0.9) V. More specifically, the amount of decrease β of the potential can be set on the basis of the ratio (capacitance ratio) of the capacitance of the capacitor 4 in the capacitance of the capacitor 4 and other capacitors.

As describe above, in the image display apparatus 1C of the third preferred embodiment, in the period P3, a first potential (−β here) is applied to the VSS line that is electrically connected to the second electrode 2*sd* of the driving transistor 2. Then, with approximately the same timing with which the Vth compensation transistor 3B changes from the conducting state to the non-conducting state, the potential Vss is controlled from the first potential to a second potential (0 V here) that is relatively higher than the first potential. Also with this configuration, even when the period P3 is shortened, the driving transistor 2 substantially goes into the non-conducting state when the Vth compensation transistor 3B changes from the conducting state to the non-conducting state. As a result, even when the period P3 is shortened, almost no differences occur in the amount of decrease of the charge accumulated in the organic EL device 1 before charge corresponding to the pixel data signal is accumulated in individual pixels in the period P4. This makes it possible to lengthen the life of the image display apparatus while suppressing luminance unevenness and cross-talk on the screen.

As compared with the image display apparatus 1A of the first preferred embodiment, the image display apparatus 1C of the third preferred embodiment, as well as the image display apparatus 1B of the second preferred embodiment, is more preferable because this does not lower the degree of freedom of design, e.g. this does not reduce the areas for the formation of the driving transistor 2 and the capacitor 4 that are important to adjust the emission luminance of the organic EL device 1.

Also, precisely adjusting the potential Vss is easier than precisely adjusting the overlap in the Vth compensation transistor 3A. Furthermore, this is preferable also in that the potential Vss can be adjusted after the pixel circuit 7B has been formed.

<Modifications>

The present invention is not limited to the above-described preferred embodiments, but numerous other modifications and variations can be devised without departing from the scope of the invention.

For example, in the image display apparatus 1A of the first preferred embodiment, the driving transistor 2 and the Vth compensation transistor 3A are both formed of an n-MISFETTFT, but this is not meant to be restrictive: the same effects as those of the image display apparatus 1A of the first preferred embodiment can be obtained when they are both formed of a thin-film transistor that is a kind of field effect transistor adopting MIS structure of a type (p type) where the carriers are holes, i.e. p-MISFETTFT.

In p-MISFETTFT, the positive/negative of the gate voltage for switching the conducting state and the non-conducting state is reverse to that in n-MISFETTFT, and therefore the amount of variation of the gate potential of the driving transistor 2 (i.e. punch-through voltage) has to be a positive value. However, while (VgL−VgH) on the right side of Expression (4) is negative in the first preferred embodiment, (VgL−VgH) on the right side of Expression (4) is replaced by a positive value in p-MISFETTFT, and therefore the punch-through voltage of the driving transistor 2 is a positive value.

Also, in the image display apparatus 1A of the first preferred embodiment, the structure of the Vth compensation transistor 3A is adjusted so that the relation of Expression (3) holds, but it is necessary to variously vary the punch-through voltage of the driving transistor 2 with circuit design factors, such as the capacitance ratio of a plurality of capacitors included in the pixel circuit 7A.

Also, in the first preferred embodiment, the parasitic capacitance CgsTthA is increased to increase the absolute value of the punch-through voltage, and as a result the amount of change of the gate voltage (voltage Vgs) of the driving transistor 2 is increased at the shift from the period P3 to the period P4, but this is not meant to be restrictive.

For example, the absolute value of the punch-through voltage can be increased by providing a capacitor having one electrode electrically connected to the sixth electrode 3*g* of the Vth compensation transistor 3A and the other electrode electrically connected to the fifth electrode 3*sd* of the Vth compensation transistor 3A, i.e. to the third electrode 2*g* of the driving transistor 2, whereby the same functions and effects as those of the first preferred embodiment can be obtained.

Also, as shown in FIG. 21, in the image display apparatus 1B of the second preferred embodiment, the potential Vlis in the periods P2 and P3 is set higher than VdH by α and the potential Vlis is lowered to 0 V when the process moves to the period P4, but this is not meant to be restrictive.

For example, the same functions and effects as those of the second preferred embodiment can be obtained when the potential Vlis in the periods P2 and P3 is set at VdH and the potential Vlis is lowered to −α that is lower by α than 0V when the process moves to the period P4 so that the potential Vlis in the period P3 is higher than the maximum value of the potential Vlis in the period P4. A specific example thereof will be described below referring to FIG. 23.

Figure 23:
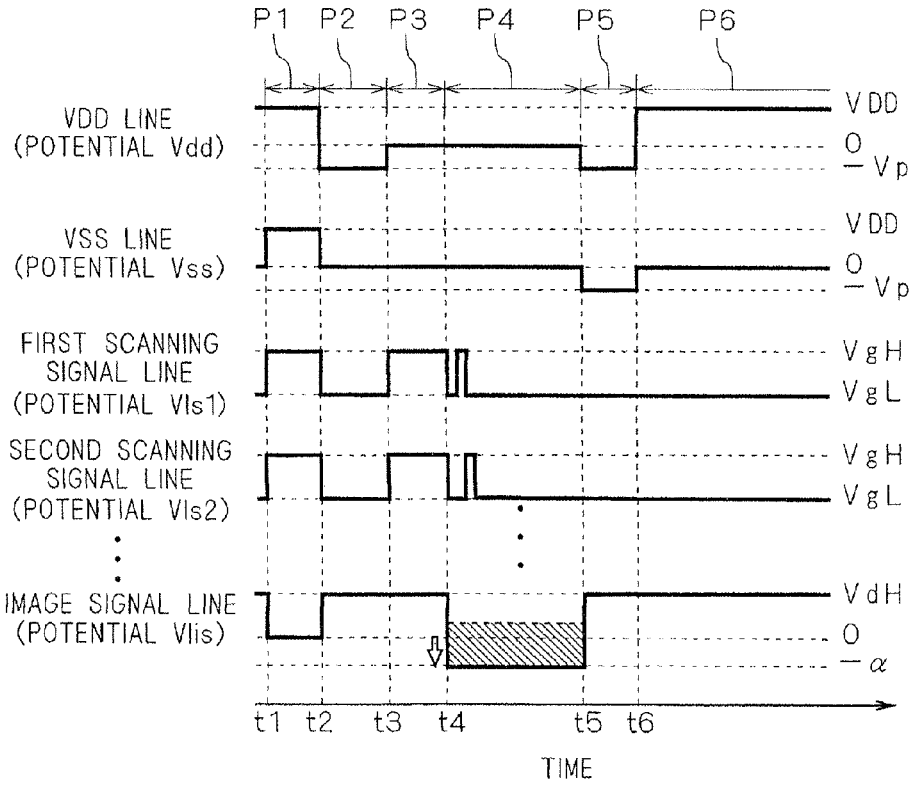
FIG. 23 is a timing chart illustrating driving waveforms for an image display apparatus according to a modification.

FIG. 23 is a timing chart showing signal waveforms (driving waveforms) for driving an image display apparatus according to a modification. FIG. 23 shows potential variation waveforms of the same kinds as those in FIG. 21.

In the driving waveforms shown in FIG. 23, the four potentials Vdd, Vss, Vls1 and Vls2 exhibit the same potential waveforms as those shown in FIG. 21.

As to the potential (potential Vlis) applied to the image signal line Lis, as compared with that shown in FIG. 21, the potential Vlis in the periods P2 and P3 (time t2 to t4) is set to a value lower by a given value α (i.e. VdH), and the minimum value and the maximum value of the potential Vlis in the period P4 (time t4 to t5) are set lower by the given value a, where the minimum value is −α and the maximum value is VdH−α. Thus, the absolute values of the potential Vlis in the periods P2 to P4 differ from those of the second preferred embodiment, but this is the same as the second preferred embodiment in that the potential Vlis in the period P3 is set to a higher potential than the maximum value of the potential Vlis in the period P4.

When the potential is set in this way, even when the period P3 is shortened, the gate voltage Vgs of the driving transistor 2 is sufficiently lowered when the process moves from the period P3 to the period P4, and the same functions and effects as those of the second preferred embodiment are obtained.

Also, in the image display apparatus 1B of the second preferred embodiment, the driving transistor 2 and the Vth compensation transistor 3B are both formed of an n-MISFETTFT, but this is not meant to be restrictive; they may both be formed of a thin-film transistor that is a kind of field effect transistor adopting MIS structure of a type (p type) where the carriers are holes, i.e. p-MISFETTFT.

However, when p-MISFETTFT is applied to the driving transistor and the Vth compensation transistor, the pixel circuit and its driving method differ.

Now, first, a pixel circuit in which p-MISFETTFT is applied to the driving transistor and the Vth compensation transistor, and its basic driving method, will be described, and then, as in the second preferred embodiment, a method of appropriately adjusting the potential applied to the image signal line so that, even when the Vth compensation period is shortened, the driving transistor goes into the non-conducting state at the shift to the writing period, will be described.

Figure 24:
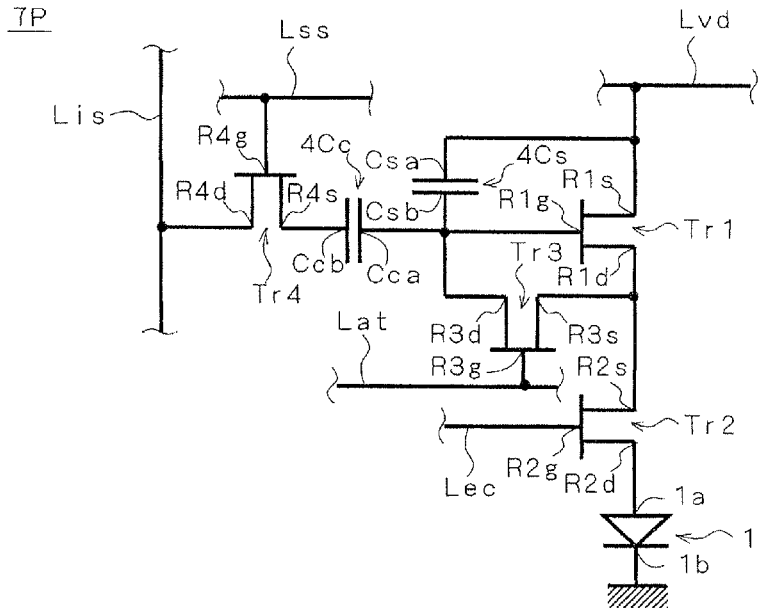
FIG. 24 is a diagram illustrating a pixel circuit 7P of an image display apparatus according to a modification.

Configuration of Pixel Circuit to which p-Type Transistors are Applied:

FIG. 24 is a diagram illustrating the circuit configuration of a pixel circuit 7P using a driving transistor and a Vth compensation transistor formed of p-MISFETTFT.

The pixel circuit 7P includes an organic EL device 1, four transistors Tr1 to Tr4, and two capacitors 4Cc and 4Cs.

The organic EL device 1 is the same as the organic EL device 1 of the first to third preferred embodiments, and its anode electrode 1*a* is electrically connected to the second electrode R2*d* of the transistor Tr2 and its cathode electrode 1*b* is grounded.

The transistor Tr1 is a driving transistor electrically connected in series with the organic EL device 1, for adjusting the emission luminance of the organic EL device 1, and it has an electrode R1*d*, an electrode R1*s*, and a control electrode (gate electrode) R1*g*. The electrode R1*d* is electrically connected to the anode electrode 1*a* of the organic EL device 1 through the transistor Tr2, the electrode R1*s* is electrically connected to a power-supply line (VDD line) Lvd to which a high potential VDD is applied when the organic EL device 1 emits light, and the gate electrode Rig is electrically connected to an electrode Cca of the capacitor 4Cc. The amount of current flowing between the electrode Rid and the electrode R1*s* is adjusted by the potential applied to the control electrode Rig, and a state in which current can flow between the electrode R1*d* and the electrode R1*s* (a conducting state) and a state in which current cannot flow (a non-conducting state) are realized.

The transistor Tr2 is electrically connected in series with the organic EL device 1, and it is a transistor for light emission control for adjusting the emission timing of the organic EL device 1, and it has an electrode R2*d*, an electrode R2*s*, and a control electrode (gate electrode) R2*g*. The electrode R2*d* is electrically connected to the anode electrode 1*a* of the organic EL device 1, the electrode R2*s* is electrically connected to the electrode R1*d* of the transistor Tr1, and the control electrode R2*g* is electrically connected to a given power-supply line (light emission control line) Lec. A state in which current can flow between the electrode R2*d* and the electrode R2*s* (a conducting state) and a state in which current cannot flow (a non-conducting state) are realized by the potential applied to the control electrode R2*g* from the light emission control line Lec.

The transistor Tr3 is a Vth compensation transistor for compensating for the threshold voltage (threshold Vth) of the driving transistor Tr1, and it has an electrode R3*d*, an electrode R3*s*, and a control electrode (gate electrode) R3*g*. The electrode R3*d* is electrically connected to an interconnection that electrically connects the control electrode R1*g* of the driving transistor Tr1 and the capacitor 4Cc, the electrode R3*s* is electrically connected to the interconnection that electrically connects the electrode R1*d* of the driving transistor Tr1 and the electrode R2*s* of the transistor Tr2, and the control electrode R3*g* is electrically connected to a given power-supply line (auto-zero line) A state in which current can flow between the electrode R3*d* and the electrode R3*s* (a conducting state) and a state in which current cannot flow (a non-conducting state) are realized by the potential applied to the control electrode R3*g* from the auto-zero line Lat.

The transistor Tr4 adjusts whether to effect the potential of the pixel data signal to the control electrode R1*g* of the driving transistor Tr1 and it has an electrode R4*d*, an electrode R4*s*, and a control electrode (gate electrode) R4*g*. The electrode R4*d* is electrically connected to the image signal line Lis, the electrode R4*s* is electrically connected to the electrode Ccb of the capacitor 4Cc, and the control electrode R4*g* is electrically connected to the scanning signal line Lss. A state in which current can flow between the electrode R4*d* and the electrode R4*s* (a conducting state) and a state in which current cannot flow (a non-conducting state) are realized by the potential applied to the control electrode R4*g* from the scanning signal line Lss.

The capacitor 4Cs has a given capacitance Cs, and has an electrode Csa and an electrode Csb. The electrode Csa is electrically connected to the interconnection that electrically connects the driving transistor Tr1 and the VDD line Lvd, and the electrode Csb is electrically connected to the interconnection that electrically connects the control electrode R1*g* of the driving transistor Tr1 and the electrode Cca of the capacitor 4Cc, whereby it is electrically connected to the control electrode R1*g*, the electrode Cca, and the electrode R3*d* of the Vth compensation transistor Tr3.

The capacitor 4Cc has a given capacitance Cc, and has an electrode Cca and an electrode Ccb. The electrode Cca is electrically connected to the control electrode R1*g* of the driving transistor Tr1, the electrode Csb of the capacitor 4Cs, and the electrode R3*d* of the Vth compensation transistor Tr3, and the electrode Ccb is electrically connected to the electrode R4*s* of the transistor Tr4.

Figure 25:
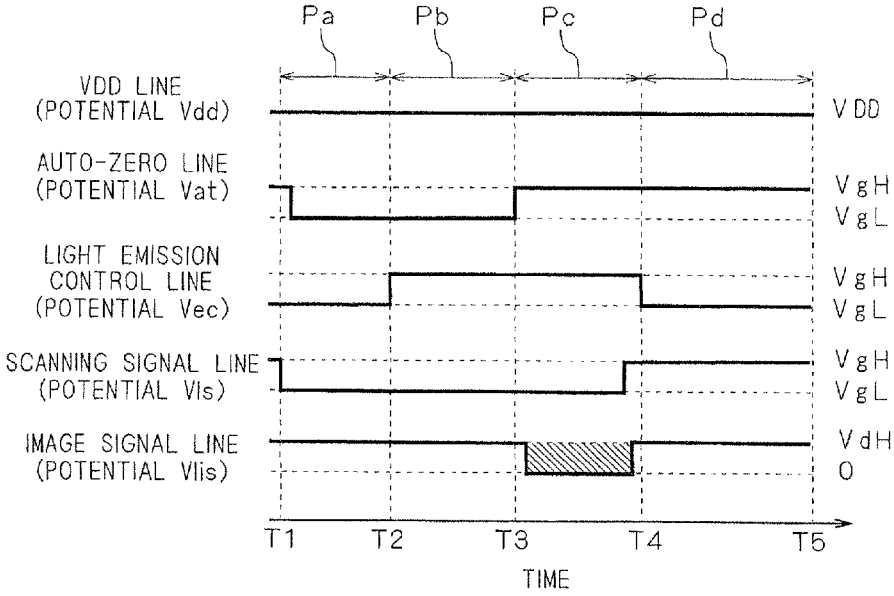
FIG. 25 is a timing chart illustrating driving waveforms for an image display apparatus according to a modification.

Method for Driving the Pixel Circuit to which p-Type Transistors are Applied:

FIG. 25 is a timing chart illustrating signal waveforms (driving waveforms) for driving the pixel circuit 7P to cause it to emit light once. In FIG. 25, the horizontal axis shows time, and the waveforms sequentially shown from top to bottom include (a) the potential applied to the VDD line Lvd (potential Vdd), (b) the potential applied to the auto-zero line Lat (potential Vat), (c) the potential applied to the light emission control line Lec (potential Vec), (d) the potential applied to the scanning signal line Lss (potential Vls), and (e) the potential applied to the image signal line Lis (potential Vlis).

FIG. 25 shows driving waveforms for causing the organic EL device 1 to emit light once, and the period for one light emission time-sequentially includes preparatory period Pa (time T1 to T2). Vth compensation period Pb (time T2 to T3), writing period Pc (time T3 to T4), and light emission period Pd (time T4 to T5). In FIG. 25, as in FIGS. 3, 18 and 21-23, the range where the potential Vlis can exist in the writing period Pc is shown with oblique hatching for the sake of convenience.

Now, the operations in the preparatory period Pa (hereinafter also referred to simply as "period Pa"), the Vth compensation period Pb (hereinafter also referred to simply as "period Pb"), the writing period Pc (hereinafter also referred to simply as "period Pc"), and the light emission period Pd (hereinafter also referred to simply as "period Pd"), will be described.

In the period Pa (time T1 to T2), the potential Vdd is set at a given positive, potential VDD, the potentials Vec and Vls are set at a given low potential VgL, and the potential Vlis is set at a given reference potential VdH. The potential Vat is varied from a given high potential VgH to a given low potential VgL immediately after the process enters the period Pa. At this time, the four transistors Tr1 to Tr4 all become conductive, and given charge is accumulated in the capacitors 4Cc and 4Cs.

Next, in the period Pb (time T2 to T3), the potential Vdd is kept at the given positive potential VDD, the potentials Vat and Vls are kept at the given low potential VgL, and the potential Vlis is kept at the given reference potential VdH, while the potential Vec is varied from the given low potential VgH, to a given high potential VgH.

In the period Pb, first, among the transistors Tr1 to Tr4, the transistor Tr2 is set in the non-conducting state, whereby positive charge moves from the electrode R1*s* of the driving transistor Tr1 to the electrode R1*d* and positive charge also moves to the control electrode R1*g* of the driving transistor Tr1 through the electrode R3*s* and the electrode R3*d* of the Vth compensation transistor Tr3. Accordingly, the potential at the control electrode R1*g* rises. Then, when charge corresponding to the difference between the reference potential VdH and the threshold Vth (VdH-Vth) has been accumulated in the capacitor 4Cc, the driving transistor Tr1 becomes non-conductive.

Next, in the period Pc (time T3 to T4), the potential Vdd is kept at the positive given potential. VDU, the potential Vec is kept at the given high potential VgH, and the potential Vls is kept at the given low potential VgL, while the potential Vat is set to the given high potential VgH. The potential Vlis is appropriately set at potential corresponding to the pixel data signal, and the potential Vls is finally varied to the given high potential VgH.

In this period Pc, the Vth compensation transistor Tr1 becomes non-conductive, and charge corresponding to the potential Vlis, i.e. charge corresponding to the pixel data signal, is accumulated in the capacitor 4Cc, and the transistor Tr4 is made non-conductive, and then the charge accumulated in the capacitor 4Cc cannot escape out of the pixel circuit 7P.

In the period Pd (time T4 to T5), the potential Vdd is set at the given positive potential VDD, the potential Vat and Vls are set at the given high potential VgH, and the potential Vlis is set at the given high potential VdH, and the potential Vec varies to the given low potential VgL. At this time, the transistor Tr2 becomes conductive, and the driving transistor Tr1 is in a conducting state where current corresponding to the pixel data signal can flow. Accordingly, current corresponding to the pixel data signal flows from the anode electrode 1*a* to the cathode electrode 1*b* of the organic EL device 1, and the organic EL device 1 emits light with desired luminance.

Figure 26:
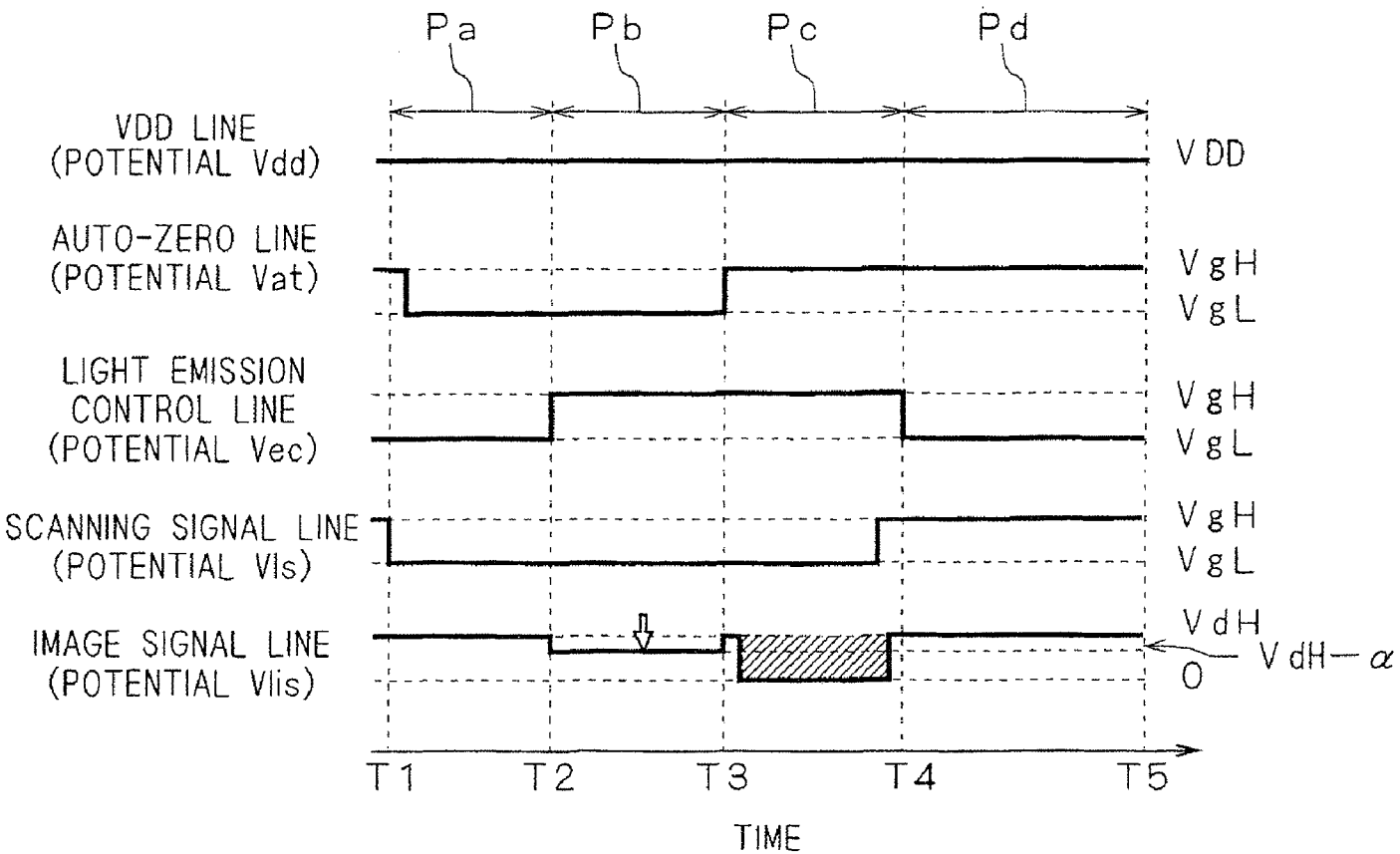
FIG. 26 is a timing chart illustrating driving waveforms for an image display apparatus according to a modification.

Method for Shortening Vth Compensation Period in the Pixel Circuit to which p-Type Transistors are Applied:

FIG. 26 is a timing chart illustrating signal waveforms (driving waveforms) for driving an image display apparatus to which p-type transistors are applied to the pixel circuits. FIG. 26 shows potential variation waveforms of the same kinds as those in FIG. 25.

The driving waveforms shown in FIG. 26 are the same as the driving waveforms shown in FIG. 25 except in that, in the period Pb (time T2 to 13), the potential Vlis applied to the image signal line Lis is set at a potential (VdH-α) that is lower by a given potential α than the reference potential VdH, and so it is lower than the maximum value of the potential Vlis in the writing period Pc (time 13 to 14).

Thus, the potential Vlis in the period Pb is adjusted to be lower than the maximum value of the potential Vlis in the period Pc, whereby the time that the driving transistor Tr1 takes to become non-conductive in the period Pb is shortened. Accordingly, even when the Vth compensation period Pb is shortened, the driving transistor Tr1 goes in a non-conducting state where almost no leakage current occurs, when the Vth compensation transistor Tr1 changes from the conducting state to the non-conducting state. As a result, the same functions and effects as those of the second preferred embodiment are obtained.

Also, in the image display apparatus 1C of the third preferred embodiment, as shown in FIG. 22, the potential Vss applied to the VSS line Lvs in the periods P2 and P3 is set lower than 0 V by a given value β, and the potential Vss is raised to 0 V when the process moves to the period P4, but this it not meant to be restrictive.

For example, the potential Vss in the periods P2 and P3 may be set at 0 V, and the Vss may be raised higher than 0 V by a given value β when the process moves to the period P4. That is, a first potential (0 V here) is applied to the VSS line Lvs in the period P3, and the potential Vss is varied from the first potential to a second potential (+β here) that is relatively higher than the first potential approximately at the same time as the timing with which the Vth compensation transistor 3B changes from the conducting state to the non-conducting state. A specific example thereof will be described referring to FIG. 27.

Figure 27:
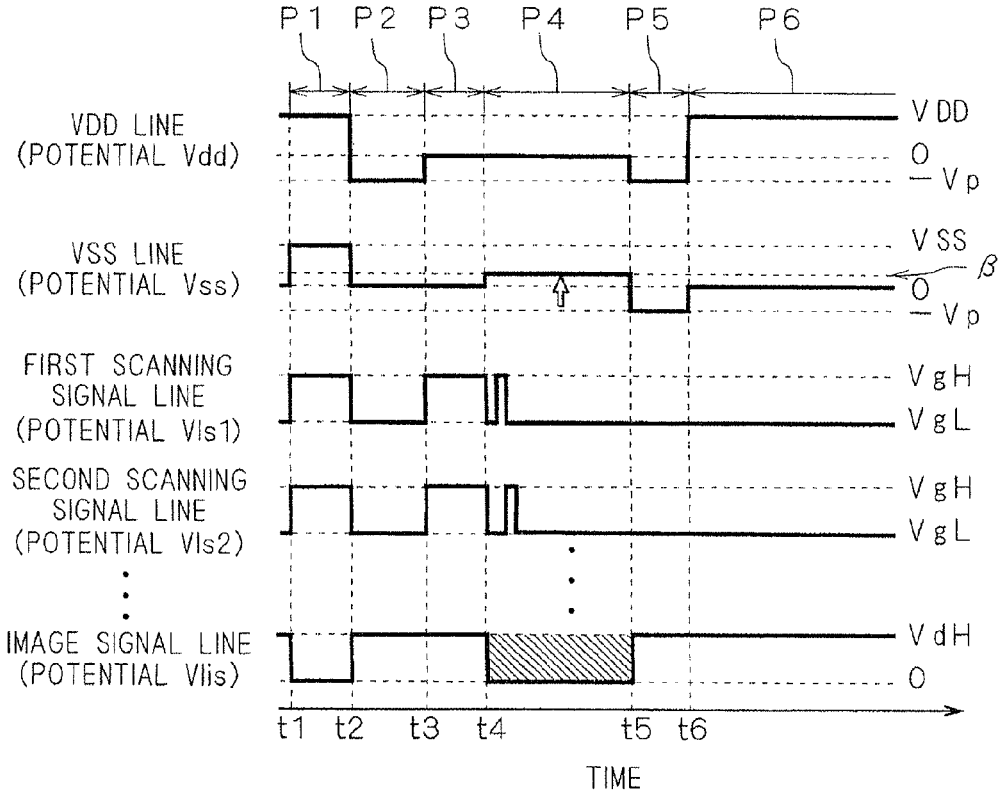
FIG. 27 is a timing chart illustrating driving waveforms for an image display apparatus according to a modification.

FIG. 27 is a timing chart illustrating signal waveforms (driving waveforms) for driving an image display apparatus according to the modification. FIG. 27 shows potential variation waveforms of the same kinds as those in FIG. 22.

In the driving waveforms shown in FIG. 27, the four potentials Vdd, Vls1, Vls2 and Vlis are the same potential waveforms as those shown in FIG. 22.

As to the potential Vss applied to the VSS line Lvs, as compared with that shown in FIG. 22, the potential in the periods P2 and P3 (time t2 to t4) and the period P4 (time t4 to t5) are controlled to be higher by a given value β. That is, the potential Vss is set at a given reference potential (0 V here) in the periods P2 and P3, and set at the given value β in the period P4. Thus, the absolute values of the potential Vss in the periods P2 to P4 differ from those of the third preferred embodiment, but this is the same as that of the third preferred embodiment in that, in the period P3, a first potential (0 V here) is applied to the VSS line Lvs, and the potential Vss is varied from the first potential to a second potential (+β here) that is relatively higher than the first potential at approximately the same time as the timing with which the Vth compensation transistor 3B changes from the conducting state to the non-conducting state.

When the potential is set in this way, the gate voltage Vgs of the driving transistor 2 is sufficiently lowered when the process moves from the period P3 to the period P4, and as a result the same functions and effects as those of the third preferred embodiment are obtained.

Also, in the image display apparatus 1C of the third preferred embodiment, the driving transistor 2 and the Vth compensation transistor 3B are both formed of n-MISFETTFT, but this is not meant to be restrictive; they may both be formed of a thin-film transistor that is a kind of field effect transistor adopting MIS structure of a type (p type) where the carriers are holes, i.e. p-MISFETTFT.

However, when p-MISFETTFT is applied to the driving transistor and the Vth compensation transistor, the pixel circuit and its driving method differ. An example of the configuration of the pixel circuit to which p-type transistors are applied is the pixel circuit 7P described with FIG. 24.

Now, a method will be described in which the potential applied to an electrode that serves as the source of the driving transistor when the organic EL device emits light is appropriately adjusted, as in the third preferred embodiment, so that, even when the Vth compensation period is shortened, the driving transistor substantially goes into the non-conducting state when the process moves to the writing period.

Figure 28:
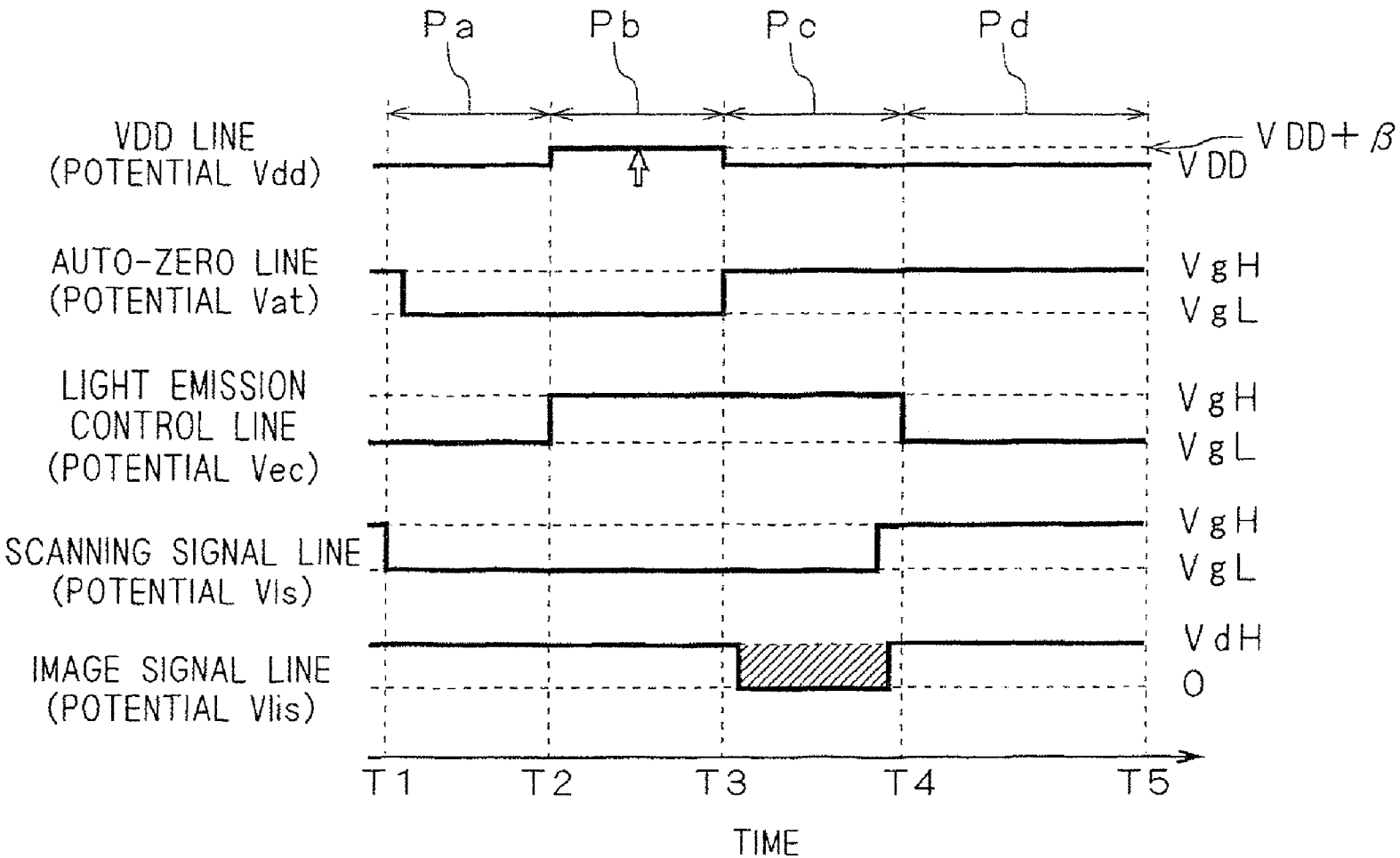
FIG. 28 is a timing chart illustrating driving waveforms for an image display apparatus according to a modification.

FIG. 28 is a timing chart illustrating signal waveforms (driving waveforms) for driving an image display apparatus to which p-type transistors are applied to the pixel circuits. FIG. 28 shows potential variation waveforms of the same kinds as those in FIG. 25.

The driving waveforms shown in FIG. 28 are the same as the driving waveforms shown in FIG. 25 except in that the potential Vdd applied to the VDD line Lvd in the period Pb (time T2 to T3) is set at a potential higher than the given high potential VDD by a given value. That is, in the driving waveforms shown in FIG. 28, a first potential (VDD+β here) is applied to the VDD line Lvd in the period Pb (i.e. the electrode R1*s* of the driving transistor Tr1), and the potential Vdd is controlled to vary from the first potential to a second potential (the given high potential VDD here) that is relatively lower than the first potential, at approximately the same time as the timing with which the Vth compensation transistor Tr1 changes from the conducting state to the non-conducting state.

In this way, the potential Vdd in the period Pb is adjusted to be higher than the potential Vdd in the period Pc, whereby, even when the period Pb is shortened, the driving transistor Tr1 goes into a non-conducting state where almost no leakage current occurs, when the Vth compensation transistor Tr1 changes from the conducting state to the non-conducting state. As a result, the same functions and effects as those of the third preferred embodiment are obtained.

The preferred embodiments described above have illustrated a mobile phone as an example of an image display apparatus, but this is meant to be illustrative and not restrictive; for example, the present invention can be applied to other kinds of image display apparatuses, such as notebook personal computers and household thin-shaped television apparatuses, to offer the same effects as those of the preferred embodiments.

Also, the preferred embodiments above have illustrated an image display apparatus using an organic EL display, but the application of the present invention is not limited to the same; for example, the present invention can be applied to image display apparatuses having an arrangement of elements of a type (current-controlled type) in which emission luminance is adjusted with the amount of current.

The invention claimed is:

1. An image display apparatus comprising:

a light-emitting device of which emission luminance varies with the amount of current;

a first transistor having first electrode, second electrode and third electrode, wherein the amount of current between the first electrode and the second electrode is adjusted by a potential applied to the third electrode;

a second transistor having fourth electrode, fifth electrode and sixth electrode, wherein the amount of current between the fourth electrode and the fifth electrode is adjusted by a potential applied to the sixth electrode; and a capacitor having seventh electrode and eighth electrode and forming a capacitance between the seventh electrode and the eighth electrode, the first electrode being electrically connected to the light-emitting device, wherein the amount of current in the light-emitting device is controlled by adjusting the amount of current between the first electrode and the second electrode, the fourth electrode being electrically connected to the first electrode, the fifth electrode being electrically connected to the third electrode, the seventh electrode being electrically connected to the third electrode, a parasitic capacitance between the fifth electrode and the sixth electrode being set at a larger value than a parasitic capacitance between the fourth electrode and the sixth electrode, wherein an amount of variation of voltage between the third electrode and the second electrode is increased as an absolute of a punch through voltage of the first transistor is increased when a process moves from a compensation period to a writing period, in the compensation period, charge corresponding to a threshold voltage of the first transistor is accumulated in the capacitor while the second transistor is set in a conducting state in which current can flow between the fourth electrode and the fifth electrode so as to compensate for the threshold voltage, and in the writing period, the charge corresponding to the emission luminance of the light-emitting device is accumulated in the capacitor.

2. The image display apparatus according to claim 1, wherein the sixth electrode is formed such that an area of a part of the sixth electrode facing the fifth electrode is larger than an area of a part of the sixth electrode facing the fourth electrode.

3. The image display apparatus according to claim 1, wherein the parasitic capacitance between the fifth electrode and the sixth electrode is set at a value that is twice or more larger than the parasitic capacitance between the fourth electrode and the sixth electrode.

4. The image display apparatus according to claim 1, wherein the first transistor and the second transistor are n-type transistors, a potential applied to the eighth electrode in the compensation period is set at a potential that is higher than a maximum value of the potential applied to the eighth electrode in the writing period.

5. The image display apparatus according to claim 1, wherein the first transistor and the second transistor are p-type transistors, a potential applied to the eighth electrode in the compensation period is set at a potential that is lower than a maximum value of the potential applied to the eighth electrode in the writing period.

6. The image display apparatus according to claim 1, wherein the first transistor and the second transistor are n-type transistors, a control section is provided to for controlling a potential applied to the second electrode to vary from a first potential to a second potential that is higher than the first potential when the second transistor changes from the conducting state to a non-conducting state where current cannot flow between the fourth electrode and the fifth electrode while the process is moves from the compensation period to the writing period.

7. The image display apparatus according to claim 1, wherein the first transistor and the second transistor are p-type transistors, a control section is provided for controlling a potential applied to the second electrode to vary from a first potential to a second potential that is lower than the first potential when the second transistor changes from the conducting state to a non-conducting state where current cannot flow between the fourth electrode and the fifth electrode while the process moves from the compensation period to the writing period.

8. An image display apparatus comprising:

a light-emitting device of which emission luminance varies with the amount of current;

a first transistor having first electrode, second electrode and third electrode, wherein the amount of current between the first electrode and the second electrode is adjusted by a potential applied to the third electrode;

a second transistor having fourth electrode, fifth electrode and sixth electrode, wherein the amount of current between the fourth electrode and the fifth electrode is adjusted by a potential applied to the sixth electrode;

a capacitor having seventh electrode and eighth electrode and forming a capacitance between the seventh electrode and the eighth electrode; and a control section for controlling a potential applied to the second electrode, the first electrode being electrically connected to the light-emitting device, wherein the amount of current in the light-emitting device is controlled by adjusting the amount of current between the first electrode and the second electrode, the fourth electrode being electrically connected to the first electrode, the fifth electrode being electrically connected to the third electrode, the seventh electrode being electrically connected to the third electrode, wherein a first potential is applied to the second electrode by the control section in a compensation period, and in the compensation period, charge corresponding to a threshold voltage of the first transistor is accumulated in the capacitor while the second transistor is set in a conducting state where current can flow between the fourth electrode and the fifth electrode so as to compensate for the threshold voltage, wherein the potential applied to the second electrode is varied by the control section from the first potential to a second potential when the second transistor changes from the conducting state to a non-conducting state where current cannot flow between the fourth electrode and the fifth electrode while a process moves from the compensation period to a writing period, in the writing period, the charge corresponding to the emission luminance of the light-emitting device is accumulated in the capacitor.

9. The image display apparatus according to claim 8, wherein the first transistor and the second transistor are n-type transistors, and the second potential is higher than the first potential.

10. The image display apparatus according to claim 8, wherein the first transistor and the second transistor are p-type transistors, and the second potential is lower than the first potential.

11. A method for driving an image display apparatus, the image display apparatus comprising:

a light-emitting device of which emission luminance varies with the amount of current;

a first transistor having first electrode, second electrode and third electrode, wherein the amount of current between the first electrode and the second electrode is adjusted by a potential applied to the third electrode;

a second transistor having fourth electrode, fifth electrode and sixth electrode, wherein the amount of current between the fourth electrode and the fifth electrode is adjusted by a potential applied to the sixth electrode; and a capacitor having seventh electrode and eighth electrode and forming a capacitance between the seventh electrode and the eighth electrode, the first electrode being electrically connected to the light-emitting device, wherein the amount of current in the light-emitting device is controlled by adjusting the amount of current between the first electrode and the second electrode, the fourth electrode being electrically connected to the first electrode, the fifth electrode being electrically connected to the third electrode, the seventh electrode being electrically connected to the third electrode, the method comprising the steps of:

compensating a threshold voltage of the first transistor by accumulating charge corresponding to the threshold voltage in the capacitor while the second transistor is set in a conducting state where current can flow between the fourth electrode and the fifth electrode in a compensation period; and accumulating charge corresponding to the emission luminance of the light-emitting device in the capacitor in writing period, wherein a first potential is applied to the second electrode in the compensation period, wherein the potential applied to the second electrode varies from the first potential to a second potential when the second transistor varies from the conducting state to a non-conducting state where current cannot flow between the fourth electrode and the fifth electrode while a process moves from the compensation period to the writing period.

12. The image display apparatus driving method according to claim 11, wherein the first transistor and the second transistor are n-type transistors, and the second potential is higher than the first potential.

13. The image display apparatus driving method according to claim 11, wherein the first transistor and the second transistor are p-type transistors, and the second potential is lower than the first potential.

* * * * *